US006250103B1

(12) United States Patent
Watanabe et al.

(10) Patent No.: US 6,250,103 B1
(45) Date of Patent: Jun. 26, 2001

(54) CONDENSER AND AIR CONDITIONING REFRIGERATION SYSTEM AND USING SAME

(75) Inventors: Hirohiko Watanabe; Ryoichi Hoshino; Yasuhiro Takahashi, all of Tochigi (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 09/544,098

(22) Filed: Apr. 6, 2000

(30) Foreign Application Priority Data

| | | |
|---|---|---|
| Apr. 7, 1999 | (JP) | 11-100285 |
| Sep. 17, 1999 | (JP) | 11-263009 |
| Feb. 17, 2000 | (JP) | 12-039000 |
| Feb. 22, 2000 | (JP) | 12-044186 |

(51) Int. Cl.[7] ..... F25B 39/04; F25B 41/06
(52) U.S. Cl. ..... 62/509; 62/511; 62/527
(58) Field of Search ..... 62/509, 498, 467, 62/511, 527, 83, 117, 474, 503

(56) References Cited

U.S. PATENT DOCUMENTS

| | | | | |
|---|---|---|---|---|
| 4,015,440 | * | 4/1977 | Pietrucha et al. | 62/166 |
| 4,193,781 | * | 3/1980 | Vogel et al. | 62/81 |
| 4,341,086 | * | 7/1982 | Ishii | 62/225 |
| 4,393,662 | * | 7/1983 | Dirth | 62/115 |
| 4,811,568 | | 3/1989 | Horan et al. . | |
| 4,831,835 | * | 5/1989 | Beehler et al. | 62/196.1 |
| 4,945,733 | * | 8/1990 | LeBrecque | 62/278 |
| 5,222,551 | | 6/1993 | Hasegawa et al. . | |
| 5,341,872 | | 8/1994 | Mercurio . | |
| 5,390,507 | | 2/1995 | Shimoya et al. . | |
| 5,615,560 | * | 4/1997 | Inoue | 62/212 |
| 5,706,666 | * | 1/1998 | Yamanaka et al. | 62/225 |
| 5,765,393 | | 6/1998 | Shlak et al. . | |
| 5,791,155 | * | 8/1998 | Tulpule | 62/211 |
| 5,971,287 | * | 10/1999 | Kettner et al. | 236/44 A |

FOREIGN PATENT DOCUMENTS

| | | |
|---|---|---|
| 0 374 896 A2 | 12/1989 | (EP) . |
| 0 497 339 A2 | 1/1992 | (EP) . |
| 0 710 808 A1 | 11/1995 | (EP) . |

* cited by examiner

*Primary Examiner*—Teresa Walberg
*Assistant Examiner*—Daniel Robinson

(57) ABSTRACT

A condenser includes a refrigerant inlet, a refrigerant outlet, a core portion having a refrigerant passage for introducing refrigerant from the refrigerant inlet to the refrigerant outlet while condensing the refrigerant, and decompressing means provided at a part of the refrigerant passage, the decompressing means decompressing a refrigerant pressure. The refrigerant passage located at an upstream side of the decompressing means condensates at least a part of high-pressure gaseous refrigerant into a liquified refrigerant. The decompressing means decompresses the liquified refrigerant into a low-pressure gaseous refrigerant. The refrigerant passage located at a downstream side of the decompressing means re-condensates the low-pressure gaseous refrigerant.

34 Claims, 16 Drawing Sheets

CONDENSER AND AIR CONDITIONING REFRIGERATION SYSTEM AND USING SAME

BACKGROUND OF THE INVENTION

1. Field of the Invention

This invention relates to a condenser and an air conditioning refrigeration system using the condenser, and more particularly to, a condenser preferably used for an automobile air conditioning refrigeration system and an air conditioning refrigeration system using the condenser.

2. Description of Related Art

An automobile air conditioning refrigeration system is usually a vapor compressing system including a compressor, a condenser, an expansion valve and an evaporator.

A refrigerant state in such a refrigeration cycle is shown in FIG. 22 which shows a Mollier diagram having a vertical axis representing a pressure and a horizontal axis representing an enthalpy. In the diagram, the refrigerant is in a liquid phase in the left hand area of the liquid phase line, in a mixed phase including gas and liquid in the area between the liquid phase line and the vapor phase line, and in a vapor phase in the right hand area of the vapor phase line.

As shown in the solid line in FIG. 22, the refrigerant compressed by the compressor changes its status from the point A to the point B, resulting in a high-temperature and high-pressure gaseous refrigerant. Then, the gaseous refrigerant cooled by the condenser changes its status from the point B to the point C, resulting in a liquified refrigerant. Next, the liquified refrigerant is decompressed and expanded by the expansion valve to change its status from the point C to the point D, resulting in a low-pressure and low-temperature refrigerant in a mist or a gaseous state. Further, the refrigerant is evaporated by exchanging heat with ambient air in the evaporator to change its status from the point D to the point A, resulting in a gaseous refrigerant. The enthalpy difference between the point D and the point A corresponds to a heat quantity for cooling ambient air. The larger the enthalpy difference is, the larger the refrigeration ability is.

Conventionally, in such a refrigeration cycle, a multi-flow type heat exchanger is well-known as a condenser for changing the refrigerant status from the point B to the point C. As shown in FIG. 23, the condenser is provided with a pair of headers 102 and a core 101. The core 101 is provided with a pair of headers 102 and a plurality of heat exchanging tubes disposed parallel to each other with the ends thereof communicated with the headers 102, 102. The plurality of heat exchanging tubes are divided into a plurality of passes P1, P2, P3 and P4 by partitions 103 provided in the headers 102. In the condenser, the refrigerant is condensed by exchanging heat with ambient air while flowing through each of the passes P1 to P4 in turn in a meandering manner.

As mentioned above, in the aforementioned refrigeration cycle, as mentioned above, the larger the enthalpy difference from the point D to the point A is, the larger the refrigeration ability is. In recent years, in the condensing process for changing the refrigerant status from the point B to the point C, a condenser which makes the enthalpy difference larger at the time of evaporation by sub-cooling the condensed refrigerant to the temperature several degrees lower than the point C to increase the heat rejection amount, has been developed.

An improved condenser having a receiver tank between the condensing zone and the sub-cooling zone has been proposed.

The condenser with the receiver tank, as shown in FIG. 24, is provided with a multi-flow type heat exchanger core 111 and a receiver tank 113 attached to one of the headers 112. An upstream portion of the heat exchanger core 111 constitutes a condensing zone 111C and a downstream portion of the heat exchanger core 111 constitutes a sub-cooling zone 111S. In this condenser, the refrigerant is condensed by exchanging heat with ambient air while flowing through each of the passes P1 to P3 of the condensing zone 111C in a meandered manner. Then, the condensed refrigerant is introduced into the receiver tank 113 to separate gaseous refrigerant and liquified refrigerant, and only the liquified refrigerant is introduced into the sub-cooling zone 111S to be sub-cooled.

In the refrigeration cycle using such a condenser, as shown in the dotted line in FIG. 22, the refrigerant compressed by the compressor changes its status from the point A to the point Bs, resulting in high-temperature and high-pressure gaseous refrigerant. Then, the gaseous refrigerant is cooled in the condensing zone 111C to change its status from the point Bs to the point Cs1, resulting in a liquified refrigerant. Furthermore, the liquified refrigerant flows through the receiver tank 113 and is sub-cooled in the sub-cooling zone 111S. Therefore, the refrigerant changes its status from the point Cs1 to the point Cs2, resulting in a perfect liquid refrigerant. Then, the liquid refrigerant is decompressed and expanded by the expansion valve and changes its status from the point Cs2 to the point Ds, resulting in a gaseous or mist refrigerant. Thereafter, the refrigerant is evaporated by the evaporator to change its status from the point Ds to the point A, resulting in a gaseous refrigerant.

In this refrigeration cycle, by sub-cooling the condensed refrigerant from the point Cs1 to the point Cs2 as shown in the diagram, the enthalpy difference (Ds to A) at the time of evaporation becomes larger than the enthalpy difference (D to A) at the time of evaporation in a normal refrigeration cycle. As a result, an excellent refrigeration effect can be obtained.

The conventional proposed condenser with a receiver tank is installed in a limited space in an engine room in the same manner as in the existing condenser shown in FIG. 23. Therefore, the size of the conventional proposed condenser with a receiver tank is basically the same as that of the existing condenser with no receiver tank. However, the lower portion of the conventional proposed condenser with a receiver tank constitutes a sub-cooling zone 111S which does not act so as to condensate the refrigerant. Therefore, the condensing zone 111C becomes smaller as compared to the existing condenser, resulting in a deteriorated condensing ability. Therefore, it is required to raise the refrigerant pressure by the compressor to send the higher-temperature and higher-pressure refrigerant to the condensing zone 111C so that the refrigerant can be assuredly condensed at such a low condensing ability. As a result, the refrigerant pressure in the refrigerant cycle, especially at the condensing zone in the refrigerant cycle, raises. As illustrated in the Mollier diagram shown in FIG. 22, in a refrigeration cycle using a conventional proposed condenser with a receiver tank, the refrigerant pressure at the condensing zone and the sub-cooling zone (Bs to Cs2) is higher than that of the normal refrigerant cycle.

As will be apparent from the above, in a conventional proposed condenser with a receiver tank, it is required to raise the refrigerant pressure, resulting in, for example, an increased load of a compressor, which in turn requires a large compressor and/or a high performance compressor.

This causes a large and heavy system, resulting in a worse fuel consumption rate and an increased manufacturing cost.

SUMMARY OF THE INVENTION

An object of the present invention is to provide a condenser which can avoid an increase of refrigerant pressure and can obtain higher refrigeration effects.

The other object of the present invention is to provide an air conditioning refrigerant system with an enhanced performance without enlarging the size and weight.

According to one aspect of the present invention, a condenser includes a refrigerant inlet, a refrigerant outlet, a core portion having a refrigerant passage for introducing refrigerant from the refrigerant inlet to the refrigerant outlet while condensing the refrigerant, and decompressing means provided at a part of the refrigerant passage, the decompressing means decompressing a refrigerant pressure.

The condenser decompresses the refrigerant pressure when condensing the refrigerant. As shown in FIG. 4, the condenser constitutes, for an example, an automobile air conditioning refrigeration system together with a compressor 2, an evaporator 4, an expansion valve 3, a receiver tank 5 and so on.

In the refrigeration system using the condenser according to the present invention, as shown in an solid line of the Mollier diagram shown in FIG. 5, the refrigerant is compressed by the compressor 2 to change the status from the point A to the point B to become a high-temperature and high-pressure gaseous refrigerant. Then, the gaseous refrigerant is condensed in the refrigerant passage located between the refrigerant inlet and the decompressing means to change the status from the point B to the point Ct1 to become a liquified refrigerant. Thereafter, the liquified refrigerant is decompressed to change its status from the point Ct1 to the point Ct2 to become a low-temperature and a low-pressure gaseous refrigerant. Then, the gaseous refrigerant is re-condensed in the refrigeration passage between the decompressing means and the refrigeration outlet to change its status from the point Ct2 to the point Ct3. Thus re-condensed refrigerant flows out of the refrigerant outlet and is introduced into a receiver tank 5. In the receiver tank 5, the refrigerant is separated into a liquified refrigerant and a gaseous refrigerant. Thereafter, only the liquified refrigerant is decompressed and expanded by the expansion valve 3 to change its status from the point Ct3 to the point Dt to become a low-pressure and a low-temperature gaseous or mist refrigerant. Then, the decompressed and expanded gaseous refrigerant is exchanged heat with ambient air by the evaporator 4 to be evaporated to change the status from the point Dt to the point A, resulting in a gaseous refrigerant.

As will be understood from the above explanation, the condenser of the present invention conducts a first condensing (B to Ct1), a decompressing (Ct1 to Ct2) and a second condensing (Ct2 to Ct3) in the aforementioned refrigeration cycle.

In the condenser, the refrigerant increases heat absorption ability by the loss of heat in the first condensing. Thereafter, the refrigerant further increases heat absorption ability by being decompressed and re-condensed. As a result, the difference of the enthalpy can be made larger at the time of evaporation, resulting in an excellent refrigeration effect. For example, the refrigeration cycle using the condenser of the present invention can obtain the same difference of the enthalpy (Dt to A) at the time of the evaporation as in the conventional proposed refrigeration cycle using a condenser with a receiver tank (see dotted line in FIG. 5), resulting in an excellent refrigeration effect.

Furthermore, the condenser according to the present invention releases heat from the refrigerant by the first and second condensations in which the phase of the refrigerant is changed, which enables an efficient release of heat as compared to the conventional proposed condenser with a receiver tank in which the heat is released by a sub-cooling without casing the phase change. In other words, the condenser according to the present invention utilizes almost all of the area as a condensing zone, which enables an efficient heat releasing, resulting in an enhanced condensing ability. Therefore, the refrigerant can be assuredly condensed without raising the refrigerant pressure in the refrigeration cycle, which in turn can decrease the load of compressor. Therefore, it is not necessary to use a large compressor, and is possible to make the refrigeration system small in size and light in weight and to enhance the fuel consumption rate at the time when the condenser is mounted in an automobile.

In the present invention, it is not necessary to completely evaporate the refrigerant by the decompressing means, and it is allowed to introduce the liquified refrigerant condensed at the upstream side of the decompressing means to the downstream side of the decompressing means without evaporating the refrigerant as it is.

However, in order to effectively prevent the refrigerant pressure rise, it is preferable to evaporate at least a part of the liquified refrigerant by the decompressing means and then to re-condense (secondly condense) the refrigerant.

It is preferable that the refrigerant passage located at an upstream side of the decompressing means condensates at least a part of high-pressure gaseous refrigerant into a liquified refrigerant, wherein the decompressing means decompresses the liquified refrigerant into a low-pressure gaseous refrigerant, and wherein the refrigerant passage located at a downstream side of the decompressing means re-condensates the low-pressure gaseous refrigerant.

It is preferable that the refrigerant passage located at an upstream side of the decompressing means condensates at least a part of high-pressure gaseous refrigerant into a liquified refrigerant, wherein the decompressing means decompresses the liquified refrigerant into a low-pressure gaseous refrigerant, and wherein the refrigerant passage located at a downstream side of the decompressing means re-condensates the low-pressure gaseous refrigerant.

Furthermore, it is preferable that a liquid holding portion for holding the liquified refrigerant is provided at the upstream side of the decompressing means.

The refrigerant passage cross-sectional area of the decompressing means may be smaller than a cross-sectional area of the refrigerant passage located at an upstream side of the decompressing means and that of the refrigerant passage located at a downstream side of the decompressing means.

It is preferable that the core portion includes a plurality of heat exchanging tubes with opposite ends thereof connected to a pair of spaced parallel headers in fluid communication. In this case, it is preferable that at least one partition provided in at least one of the headers to divide the plurality of heat exchanging tubes into a plurality of passes is further provided, whereby the refrigerant passes each of the passes in turn, wherein the plurality of passes include a first pass to which the refrigerant inlet is connected and a final pass to which the refrigerant outlet is connected, and wherein the decompressing means is disposed at a part of the refrigerant passage located between the first pass and the final pass.

The plurality of passes may include the first pass, the final pass and one or a plurality of intermediate passes, and wherein at least one of the intermediate passes constitutes a decompressing pass as the decompressing means.

The decompressing means may be provided in the header.

The decompressing means may include a plate member partitioning an inside of the header and an orifice tube penetrating the plate member for passing refrigerant.

Alternatively, the decompressing means may be a reduced diameter portion of the header.

Furthermore, the decompressing means may include a plate member partitioning an inside of the header and a refrigerant detour pipe with one end thereof connected to the header in fluid communication at an upstream side of the plate member and the other end thereof connected to the header in fluid communication at a downstream side of the plate member.

In a case of a multi-flow type condenser, it may comprise a receiver tank, wherein the receiver tank is disposed at an upstream side of the decompressing means so that the receiver tank receives liquified refrigerant liquified by the refrigerant passage located at an upstream side of the decompressing means to separate the liquified refrigerant into a liquid refrigerant and a gaseous refrigerant and introduces the liquid refrigerant into the decompressing means, whereby the liquid refrigerant is decompressed by the decompressing means into a low-pressure gaseous refrigerant which in turn is re-condensed by the refrigerant passage located at a downstream side of the decompressing means.

According to the second aspect of the present invention, a refrigeration system for use in an air conditioner which constitutes a refrigeration cycle in which refrigerant is sealed, comprising:

a compressor;

a condenser;

a decompressing member such as an expansion valve; and an evaporator, wherein the condenser includes:

a refrigerant inlet for introducing refrigerant sent from the compressor into the condenser;

a refrigerant outlet for sending the refrigerant from the condenser to the decompressing member;

a heat exchanging portion having a refrigerant passage for introducing the refrigerant to the refrigerant outlet while condensing the refrigerant introduced from the refrigerant inlet; and a decompressing portion provided at a part of the refrigerant passage for decompressing a refrigerant pressure, wherein the heat exchanging portion includes a pair of parallel headers disposed at a certain distance, a plurality of heat exchanging tubes with opposite ends connected to the headers in fluid communication and at least one partitioning member provided at at least one of the headers to divide the plurality of heat exchanging tubes into a plurality of heat exchanging passes, whereby the refrigerant passes through each of the passes in turn, wherein the plurality of passes include a first pass connected to the refrigerant inlet and a final pass connected to the refrigerant outlet, wherein the decompressing portion is provided at a part of the refrigerant passage between the first pass and the final pass, wherein the decompressing portion has a passage cross-sectional area smaller than a cross-sectional area of the refrigerant passage adjacent to the decompressing portion at an upstream side of the decompressing portion and that of the refrigerant passage adjacent to the decompressing portion at a downstream side of the decompressing portion, wherein the refrigerant passage located at an upstream side of the decompressing means condenses at least a part of a high-pressure gaseous refrigerant compressed by the compressor by exchanging heat between the high-pressure gaseous refrigerant and ambient air into a liquified refrigerant, wherein the decompressing portion decompresses the liquified refrigerant into a low-pressure gaseous refrigerant, and wherein the refrigerant passage located at a downstream side of the decompressing means re-condenses the low-pressure gaseous refrigerant by exchanging heat between the low-pressure gaseous refrigerant and ambient air.

BRIEF DESCRIPTION OF THE DRAWINGS

The above and other objects, features, and advantages of the present invention will be apparent from the following detailed description of the preferred embodiments with reference to the attached drawings, wherein:

FIG. 18 is a cross-sectional front view of the flat tube shown in FIG. 17.

DETAILED DESCRIPTION OF THE PREFERRED EMBODIMENTS

Preferred embodiments according to the present invention will be explained with reference to the attached drawings.

Figure 1:
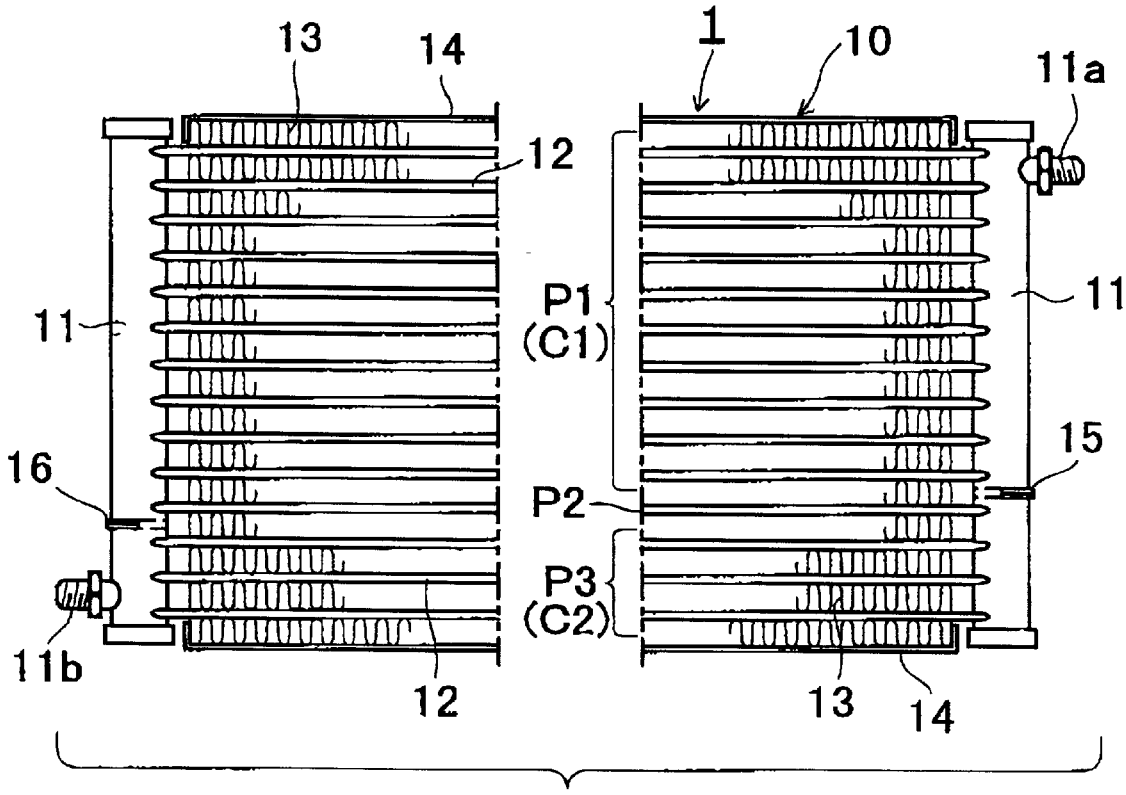
FIG. 1 is a front view of a condenser according to a first embodiment of the present invention.

FIG. 1 shows a front view of a multi-flow type condenser according to a first embodiment of the present invention.

The core 10 of the condenser 1 is provided with a pair of right and left headers 11, 11 disposed apart from each other, a plurality (i.e., fourteen) of horizontal flat tubes 12 as heat exchanging tubes with opposite ends connected to the headers 11 in fluid communication. Furthermore, corrugate fins 13 are disposed between adjacent flat tubes 12 and also on the outer surfaces of the outermost flat tubes 12. Also, side plates 14 are disposed on the outermost corrugate fins 13 to protect them.

Figure 3:
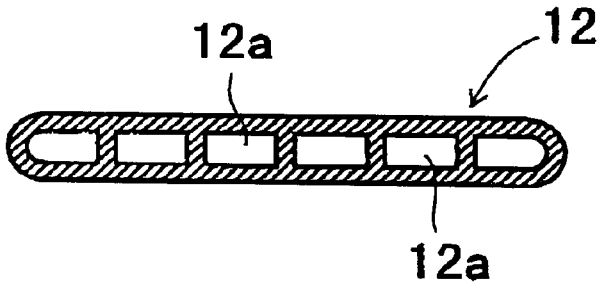
FIG. 3 is a cross-sectional view of a flat tube employed as a heat exchanging tube of the condenser according to the first embodiment of the present invention.

As shown in FIG. 3, the so-called harmonica tube with a plurality of refrigerant passage 12*a* is generally used as the flat tube 12.

At an upper end portion of the right-hand header 11, a refrigerant inlet 11*a* such as a union nut is provided. On the other hand, at a lower end portion of the left-hand header 11, a refrigerant outlet 11*b* such as a union nut is provided.

Figure 2:
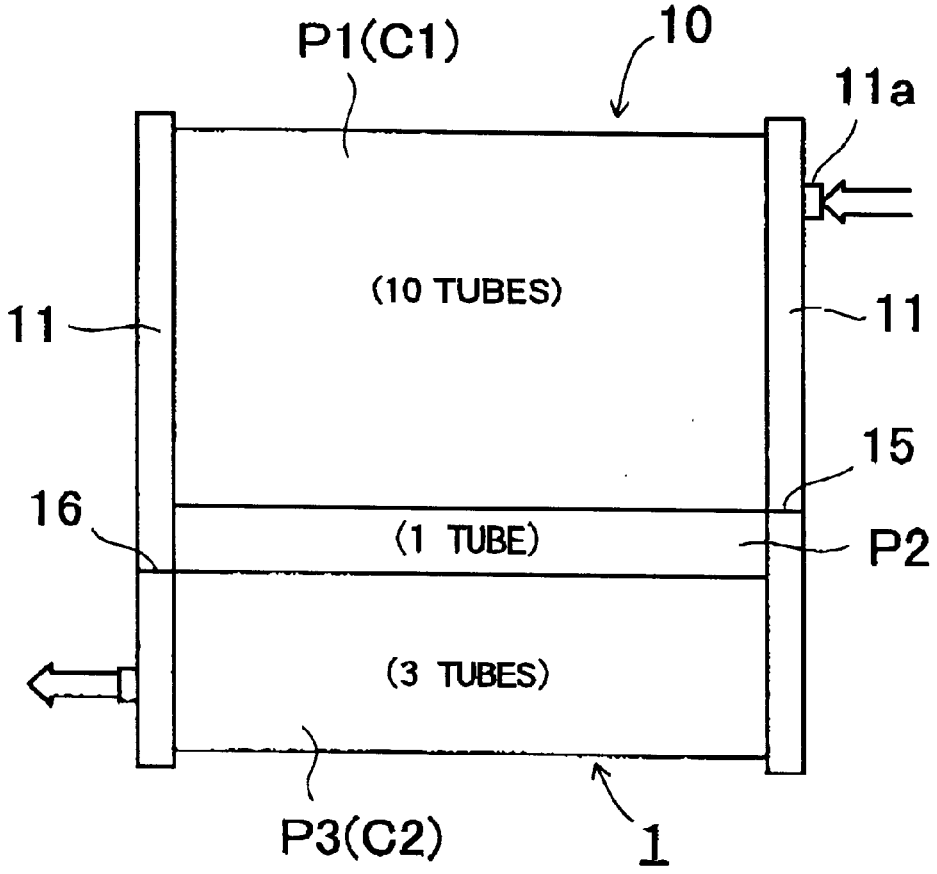
FIG. 2 illustrates a refrigerant circuit structure of the condenser according to the first embodiment of the present invention.

As shown in FIGS. 1 and 2, a partition 15 is provided in the right-hand header 11 so as to be located between the $10^{th}$ and $11^{th}$ flat tubes 12 from the top to partition the inside of the header 11. Another partition 16 is provided in the left-hand header 11 so as to be located between the $11^{th}$ and $12^{th}$ flat tubes from the top to partition the inside of the header 11. Accordingly, a first pass P1 is formed by the $1^{st}$ to $10^{th}$ flat tubes 12, a second pass P2 as a decompressing pass (a decompressing means) is formed by the $11^{th}$ flat tube 12 and a third pass P3, i.e., a final pass, is formed by the $12^{th}$ to $14^{th}$ flat tubes 12.

In the condenser 1, the core 10 is divided by the second pass P2 and a decompressing means into the upper first pass (P1), i.e., a first condensing zone C1, and a lower third pass (P3), i.e., a second condensing zone C2.

In the condenser 1, refrigerant introduced into the header 11 through the refrigerant inlet 11*a* passes through the core 10 by way of the first pass P1 to the third pass P3 in this order in a meandering manner. Then, the refrigerant flows out from the refrigerant outlet 11*b*.

Figure 4:
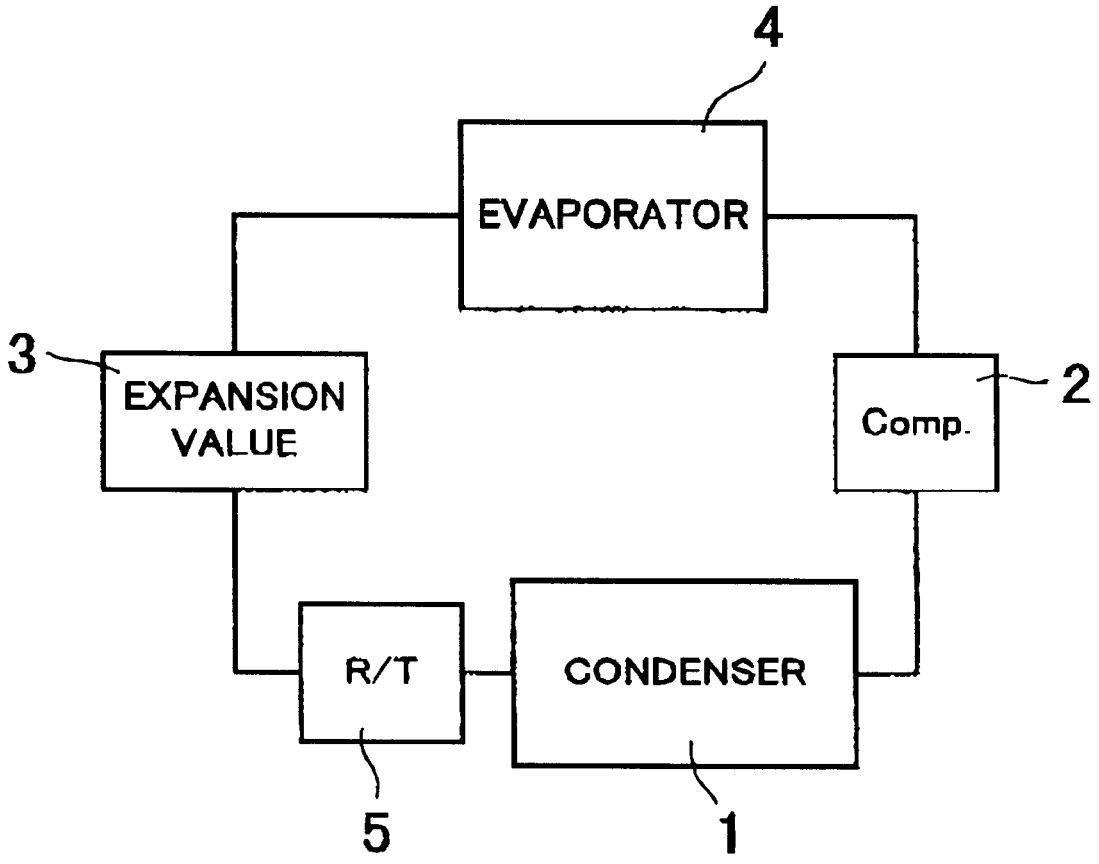
FIG. 4 illustrates a block diagram showing a refrigeration system in which the condenser according to the present invention employed.

As shown in FIG. 4, the aforementioned condenser 1 constitutes an automobile air conditioning refrigeration system together with a compressor 2, a receiver tank 5, a decompressing member such as an expansion valve 3 and an evaporator 4 connected by refrigerant pipes.

Figure 5:
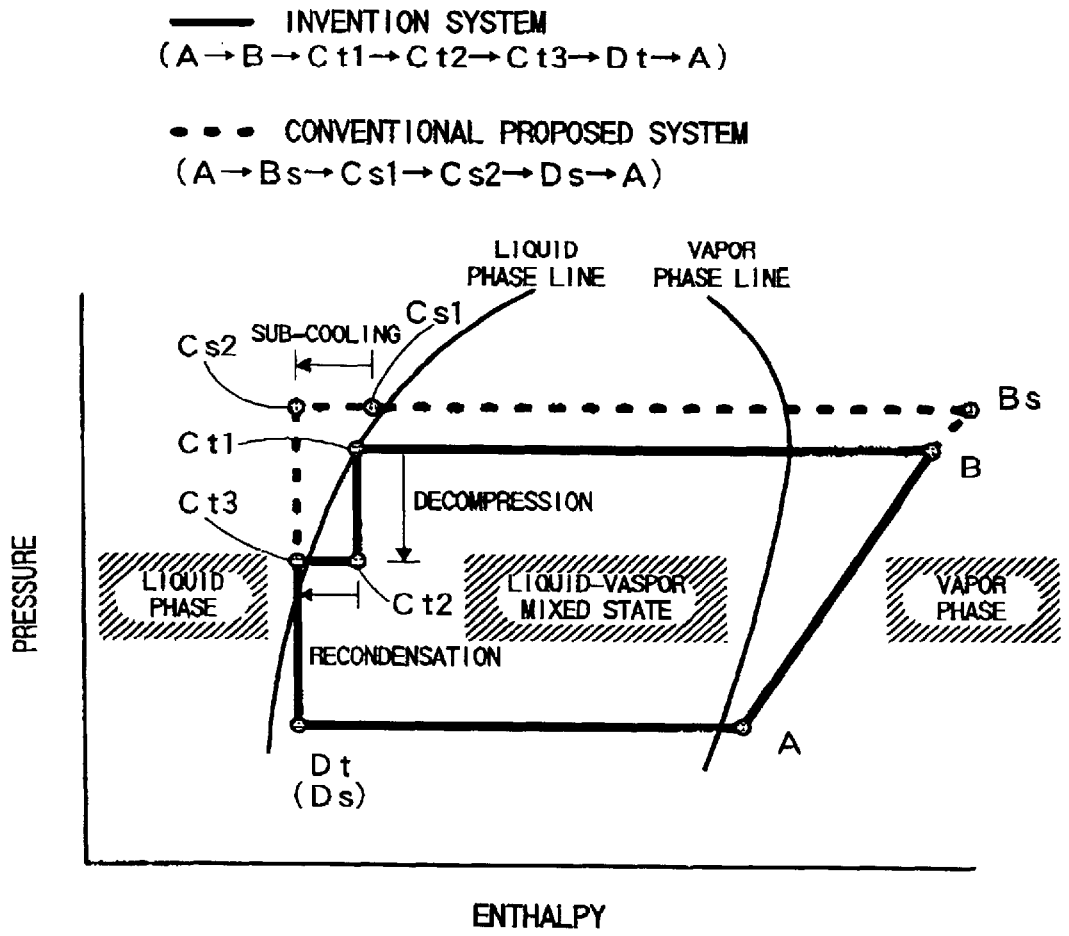
FIG. 5 illustrates a Mollier diagram in the refrigeration system in which the condenser according to the present invention is employed.

In this refrigeration system, gas refrigerant with high-temperature and high-pressure sent out from the compressor 2 flows into the condenser 1. In the condenser 1, the refrigerant passes through the first pass P1, i.e., the first condensing zone C1, to be condensed and liquified. As a result, the status of the refrigerant changes from the point B to the point Ct1, as shown in FIG. 5. Then, the refrigerant flows into the decompressing pass P2.

The number of tubes and the total passage cross-sectioned area of the decompressing pass P2 are smaller than those of the upstream pass P1. Therefore, when the refrigerant passes through the decompressing pass P2, the refrigerant flow speed increases to cause a decompression of the refrigerant, resulting in an evaporation of some amount of the refrigerant. As a result, the status of the refrigerant changes from the point Ct1 to the point Ct2, as shown in FIG. 5. Then, the refrigerant is introduced into the final pass P3, i.e., the second condensing zone C2. Thereafter, the low-pressure gaseous refrigerant is further cooled and condensed to lose a large amount of heat in the second condensing zone C2. As a result, the status of the refrigerant changes from the point Ct2 to the point Ct3, as shown in FIG. 5.

The refrigerant having an increased heat absorption ability by the loss of a large amount of heat is separated into gaseous refrigerant and liquified refrigerant. Then, only the liquified refrigerant is decompressed and expanded by the expansion valve 3 to cause a change of the refrigerant status from the point Ct3 to the point Dt, as shown in FIG. 5. Thereafter, the low-pressure and low-temperature refrigerant in a gaseous state is sent into the evaporator 4 to be evaporated by exchanging heat with air in a car. As a result, the status of the refrigerant changes from the point Dt to the point A, as shown in FIG. 5. Then, the refrigerant is sent back into the condenser 1.

As is apparent from the above, in the condenser 1 according to the present invention, after the refrigerant is condensed in the first condensing zone C1, it is decompressed. Thereafter, it is again condensed in the second condensing zone C2. This enables a gradual increase of the heat absorption amount (heat absorption ability) of the refrigerant. Therefore, the difference of enthalpy (Dt to A) at the time of evaporation of the refrigerant can be obtained as large as in the refrigeration cycle including a conventional condenser with a receiver tank, resulting in an excellent refrigeration effect.

Furthermore, in the condenser 1 according to the present invention, after the first condensing (the point B to the point Ct1) is conducted to reject heat, the second condensing (the point Ct2 to the point Ct3) with a phase change is conducted to enlarge the heat rejection amount. Therefore, as compared with a conventional condenser with a receiver tank in which a heat rejection amount of the liquid refrigerant is increased by a sub-cooling without a phase change, heat can be effectively rejected. In other words, in the condenser of the embodiment, almost whole area of the condenser constitutes the condensing zones C1 and C2 to effectively reject heat of the refrigerant, resulting in an excellent condensing ability. Therefore, the refrigerant can assuredly be condensed without rasing the refrigerant pressure in the refrigeration cycle which enables a lightening of the load of the compressor. Accordingly, a large-sized compressor can be avoided; a refrigeration system can be smaller and lightened; fuel efficiency of a car mounting the condenser can be enhanced; and a manufacturing cost of the condenser can be reduced.

In the condenser 1 according to the embodiment, in a case where the refrigerant introduced into the decompressing pass P2 is not completely liquified, the refrigerant flowing through the decompressing pass P2 has a large volume because of the existence of the gaseous refrigerant, which causes an increased flow resistance of the refrigerant in the decompressing pass P2, resulting in a reduced flow amount of the refrigerant in the decompressing pass P2 due to the obstructed flow thereof. This deterioration of the flow amount decreases the condensing load in the upper pass, which enhances the refrigerant condensation in the upper pass, whereby only the completely liquified refrigerant is introduced into the decompressing pass P2. In other words, the decompressing pass P2 has self-control function for controlling the refrigerant flow amount, and acts as an orifice tube. Accordingly, the decompressing pass P2 is always kept in the best condition. In the decompressing pass P2, a part of the refrigerant is evaporated to become gaseous refrigerant while the refrigerant is decompressed and cooled at the same time and introduced into the final pass P3. In the final pas P3, as mentioned above, the refrigerant is assuredly re-condensed. Therefore, the heat rejection amount of the refrigerant can be always kept high, resulting in an excellent refrigerant effect.

As mentioned above, the condenser 1 according to the present invention, the refrigerant pressure can be avoided to be raised and an excellent refrigeration effect can be obtained.

In the condenser 1 according to the present invention, not like the condenser with the receiver tank in the conventional proposal, a separate unit from the core can be used as a receiver tank 5. Therefore, the installation place for the receiver tank 5 is not limited and it is not required to have a complicated structure as in the condenser with the receiver tank in the conventional proposal. Thus, the structure can be simplified. The cost is further reduced and the installation space can be reduced.

In the present invention, it is preferable that the total cross-sectional passage area of the decompressing pass P2 is set to 2% to 10% of the total cross-sectional passage area of the passes P1 to P3. When the total cross-sectional passage area of the decompressing pass P2 is too large, the refrigerant cannot be fully decompressed in the decompressing pass P2, so that the decompressing pass P2 might not fully display the self control function as an orifice tube. On the other hand, when the total cross-sectional passage area is too small, the refrigerant cannot flow smoothly and the refrigerant might not circulate fully.

In the aforementioned embodiment, the total cross-sectional passage area (%) of the decompressing pass P2 against the total cross-sectional passage area of the passes P1 to P3 can be expressed as follows:

(the number of the tubes of the decompressing pass P2)/(the number of the tubes of the passes P1 to P3)×100.

Therefore, it can be expressed as 1/14×100=7.14% in the embodiment, which is in the preferable range.

Figure 6:
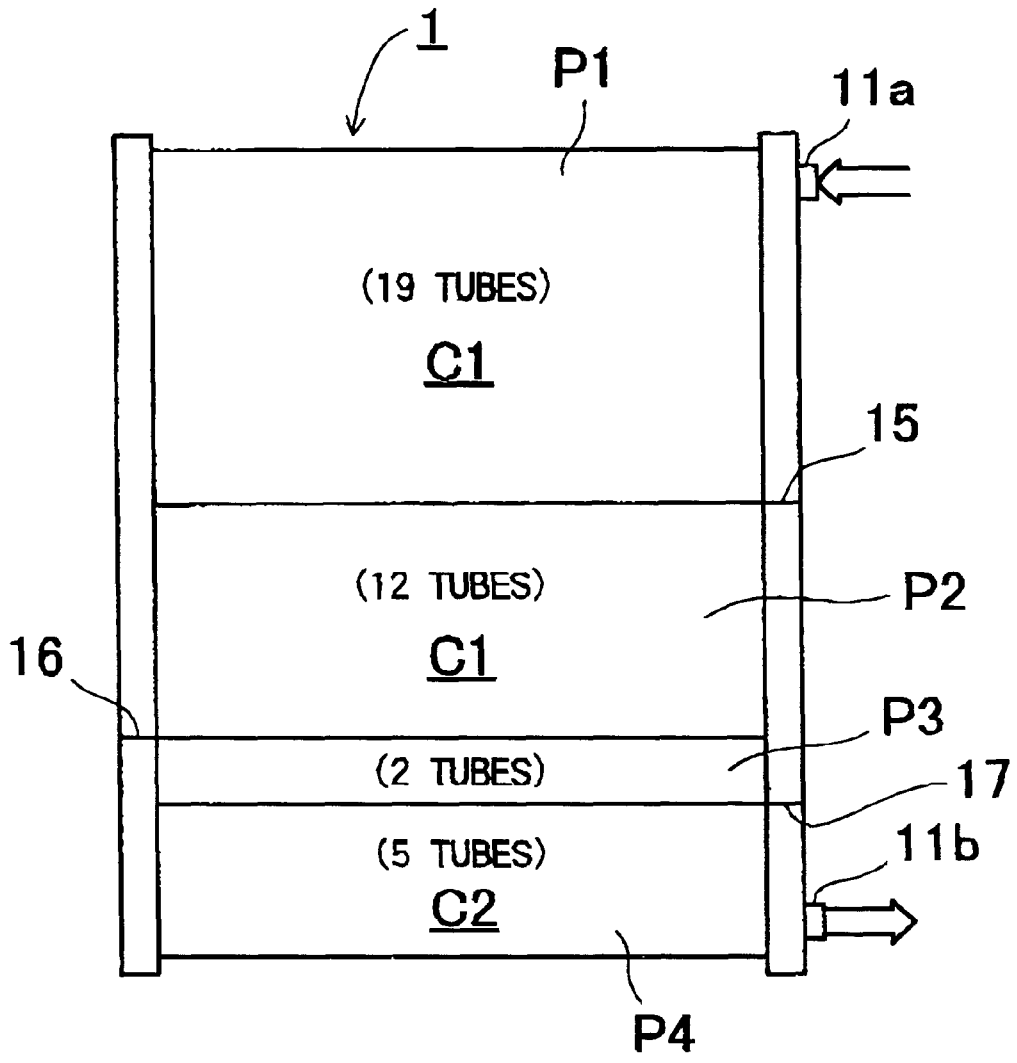
FIG. 6 illustrates a refrigerant circuit structure of the condenser according to the second embodiment of the present invention.

FIG. 6 shows a second embodiment of the present invention.

In the present invention, the number of passes, the number of tubes in each pass, and especially the number of tubes constituting the decompressing pas are not limited. For example, the condenser shown in FIG. 6 is provided with four passes P1, P2, P3 and P4. The third pass P3 including two tubes constitutes a decompressing pas (decompressing means).

Since the other structure is the same as in the aforementioned embodiment, the explanation will be omitted by allotting the same reference numeral to the corresponding portion.

Figure 7:
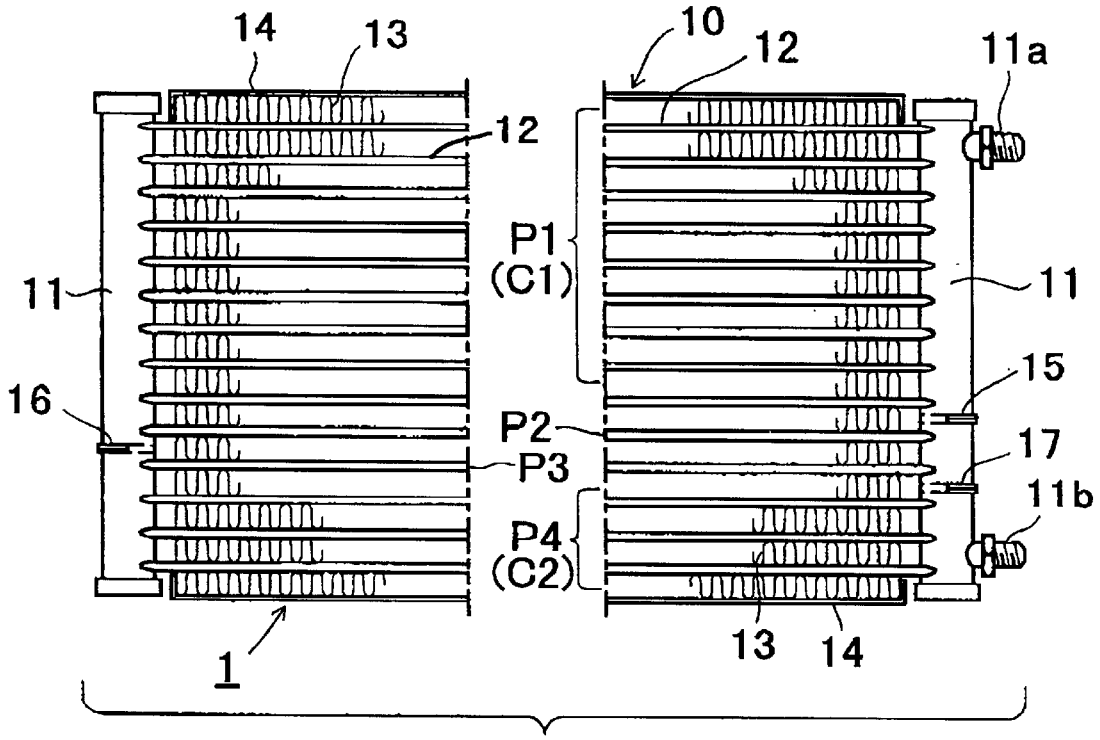
FIG. 7 is a front view of a condenser according to a third embodiment of the present invention.
Figure 8:
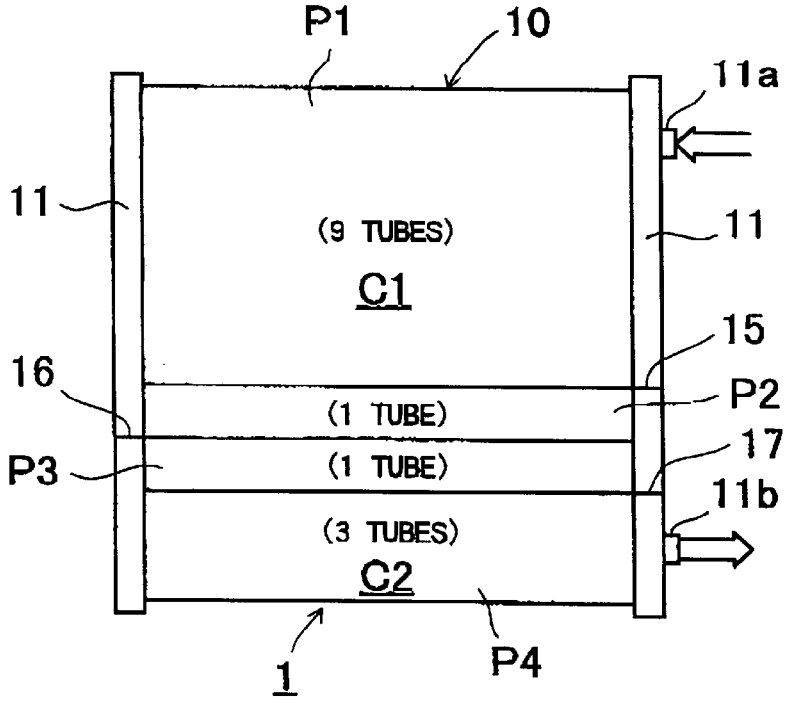
FIG. 8 illustrates a refrigerant circuit structure of the condenser according to the third embodiment of the present invention.

FIGS. 7 and 8 show a third embodiment of the present invention.

In the present invention, two or more decompressing passes may be provided. For example, in the condenser shown in FIGS. 7 and 8, the headers 11 are partitioned by partitions 15, 16, 17 to form four passes P1, P2, P3, P4. Each of the second and third passes P2 and P3 each including a single tube 12 constitutes a decompressing pass.

Since the other structure is the same as in the aforementioned embodiment, the explanation will be omitted by allotting the same reference numeral to the corresponding portion.

Figure 9:
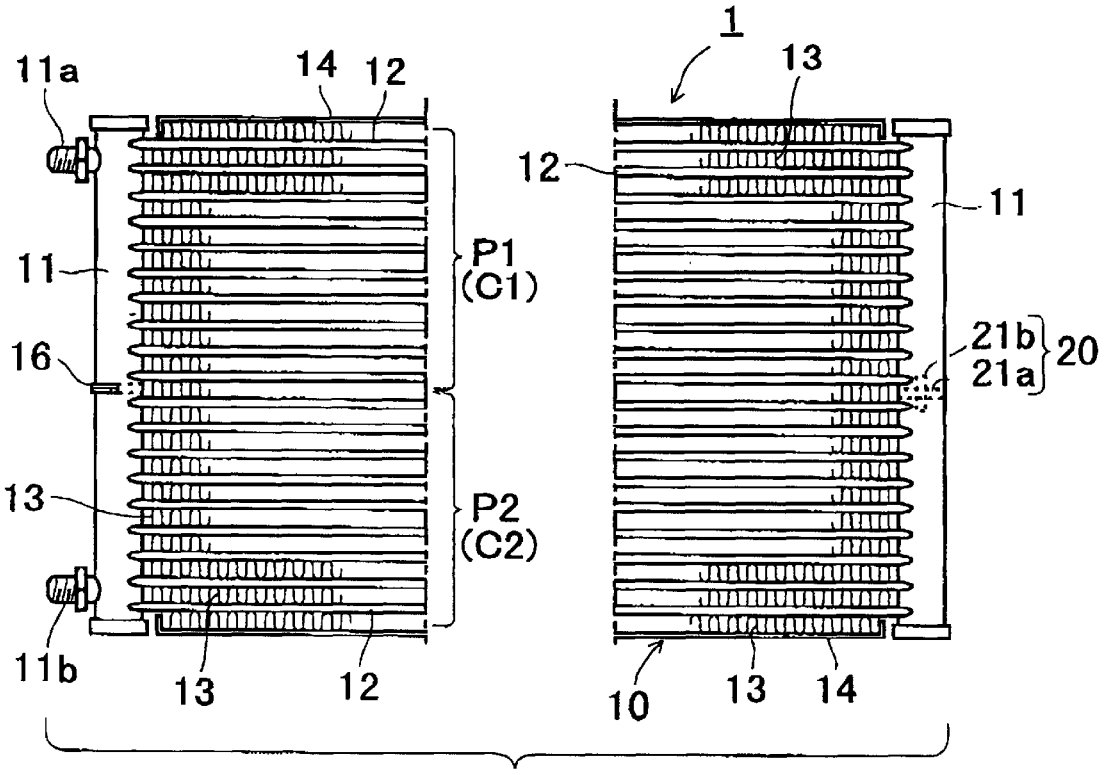
FIG. 9 is a front view of a condenser according to a fourth embodiment of the present invention.

FIGS. 9 and 10 show a fourth embodiment of the present invention.

Contrary to the first to third embodiments in which a decompressing means is constituted by a heat exchanging tube, in the fourth embodiment, the decompressing means is provided within a header.

The condenser has a basic structure as a multi-flow type heat exchanger. In the condenser, a partition 16 is provided in the longitudinal central portion of the left head header 11 to form a first pass P1 including a plurality of flat tubes 12 located above the partition 16 and a second pass P2 including a plurality of flat tubes 12 located below the partition 16.

Figure 10A:
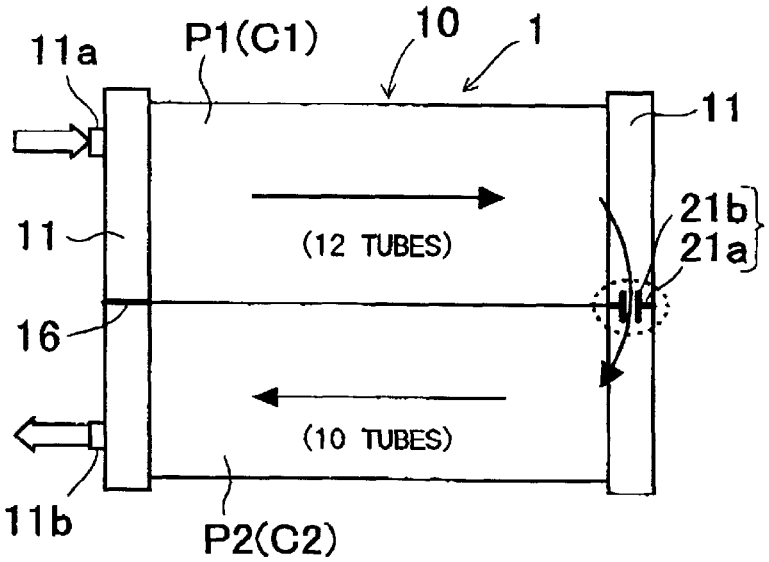
FIG. 10A illustrates a refrigerant circuit structure of the condenser according to the fourth embodiment of the present invention.

As shown in FIG. 10A, the condenser 1 according to this embodiment includes a total of twenty two (22) flat tubes 12. A partition 16 is provided in the left-hand header 11 so as to be located between the $12^{th}$ and $13^{th}$ flat tubes 12 from the top to partition the inside of the header 11. Accordingly, a first pass P1 is formed by the $1^{st}$ to $12^{th}$ flat tubes 12, a second pass P2 is formed by the $13^{th}$ to $22^{nd}$ flat tubes 12.

Figure 10B:
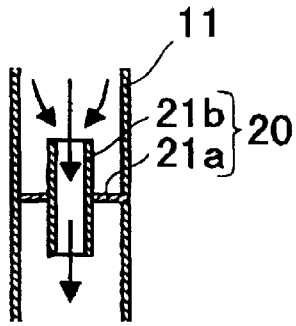
FIG. 10B illustrates a schematic enlarged cross-sectional view showing the portion of the FIG. 10A surrounded by the dotted line.

As shown in FIG. 10B, between the first and second passes P1, P2 in the right hand header 11, a decompressing means 20 according to this embodiment is provided. This decompressing means 20 includes a plate member 21*a* partitioning the inside of the header 11 and an orifice tube 21*b* as a small tube through which refrigerant can pass. The orifice tube 21*b* is penetrated in the central portion of the plate member 21*a*.

In the condenser 1, the upstream pass P1 above the decompressing means 20 constitutes a first condensing portion C1, and the downstream pass P2 below the decompressing means 20 constitutes a second condensing portion C2(re-condensing portion).

In the condenser 1, refrigerant introduced into the header 11 through the refrigerant inlet 11*a* passes through the core 10 by way of the first pass P1 to the right hand header 11. Then, the refrigerant passes through the decompressing means 20 and then passes through the second pass P2 to reach the left side header 11. Then, the refrigerant flows out from the refrigerant outlet 11*b*.

As shown in FIG. 4, the aforementioned condenser 1 constitutes an automobile air conditioning refrigeration system together with a compressor 2, a receiver tank 5, a decompressing member such as an expansion valve 3 and an evaporator 4 connected by refrigerant pipes.

In this refrigeration system, gas refrigerant with high-temperature and high-pressure sent out from the compressor 2 flows into the condenser 1. In the condenser 1, the refrigerant passes through the first pass P1, i.e., the first condensing zone C1, to be condensed and liquified. As a result, the status of the refrigerant changes from the point B to the point Ct1, as shown in FIG. 5. Then, the refrigerant flows into the orifice tube 21*b* constituting the compressing means 20.

Since the orifice tube 21*b* is small in passage cross-sectional area, when the refrigerant passes through the orifice tube 21*b*, the refrigerant flow speed increases to cause a decompression of the refrigerant, resulting in an evaporation of some amount of the refrigerant. As a result, the status of the refrigerant changes from the point Ct1 to the point Ct2, as shown in FIG. 5. Then, the refrigerant is introduced into the second pass P2, i.e., the second condensing zone C2. Thereafter, the low-pressure gaseous refrigerant is further cooled and condensed to lose a large amount of heat in the second condensing zone C2. As a result, the status of the refrigerant changes from the point Ct2 to the point Ct3, as shown in FIG. 5.

The refrigerant having an increased heat absorption ability by the loss of a large amount of heat is separated into gaseous refrigerant and liquified refrigerant. Then, only the liquified refrigerant is decompressed and expanded by the expansion valve 3 to cause a change of the refrigerant status from the point Ct3 to the point Dt, as shown in FIG. 5. Thereafter, the low-pressure and low-temperature refrigerant in a gaseous state is sent into the evaporator 4 to be evaporated by exchanging heat with air in a car. As a result, the status of the refrigerant changes from the point Dt to the point A, as shown in FIG. 5. Then, the refrigerant is sent back into the condenser 1.

Furthermore, in the condenser according to this embodiment, since the decompressing means 20 is provided in the header 11, an enhanced refrigeration effect can be obtained. In other words, in a case where a decompressing means is provided in a heat exchanging tube such as a flat tube, for example, the heat exchanging tube provided with the decompressing means does not function as a heat exchanging portion, resulting in a reduced effective core area. To the contrary, in this embodiment, since the decompressing means 20 is disposed in the header 11, all of the flat tubes 12 can be utilized as a heat exchanging portion, resulting in an increased effective core area, which can enhance the refrigeration effect.

Since the other structure is the same as in the aforementioned embodiment, the explanation will be omitted by allotting the same reference numeral to the corresponding portion.

Figure 11:
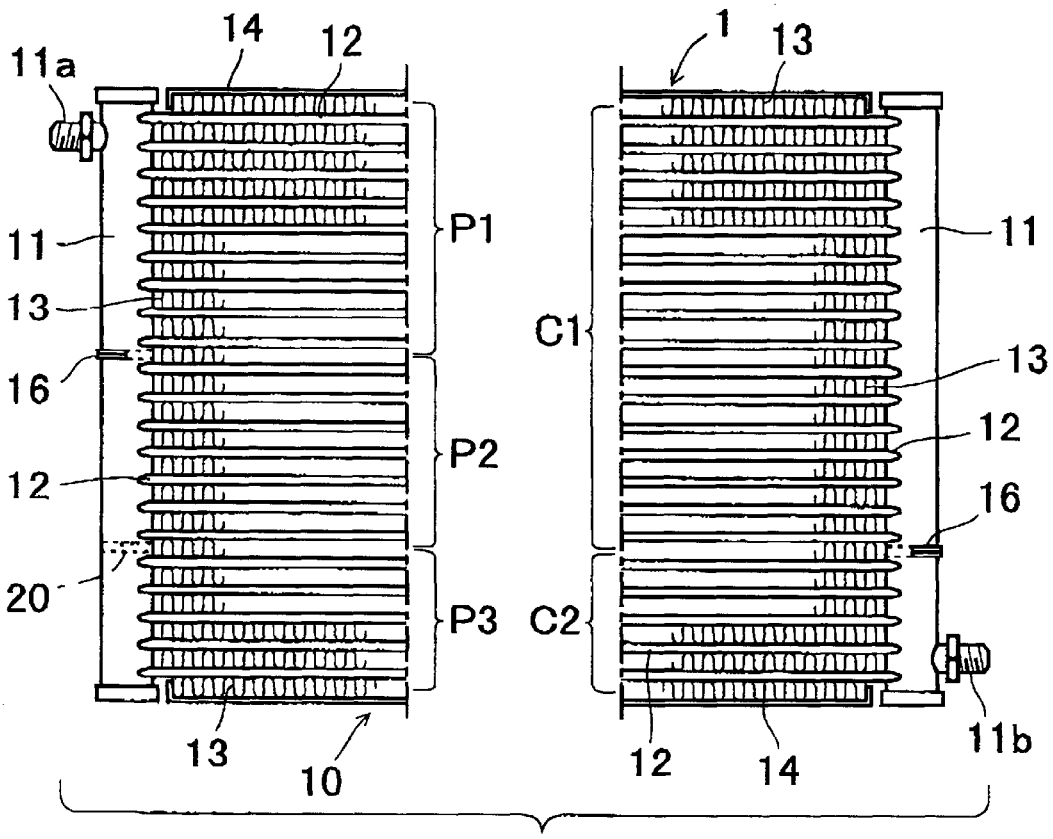
FIG. 11 is a front view of a condenser according to a fifth embodiment of the present invention.
Figure 12:
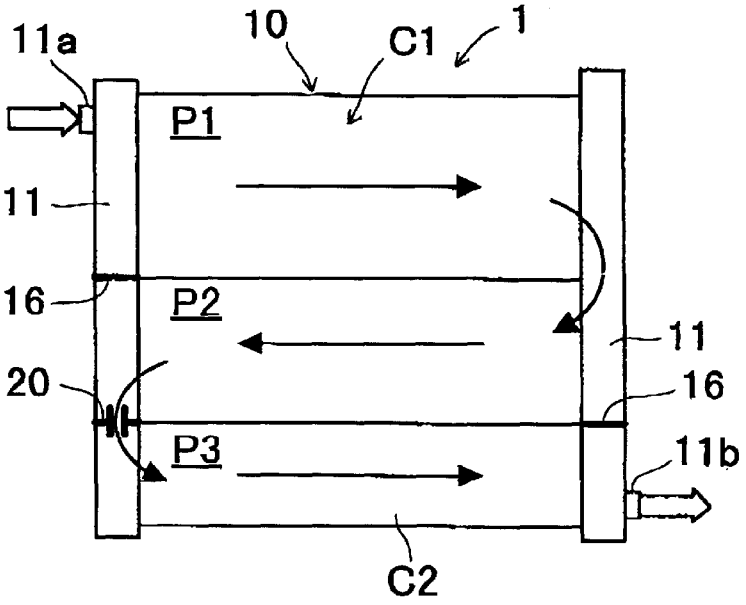
FIG. 12 illustrates a refrigerant circuit structure of the condenser according to the fifth embodiment of the present invention.

FIGS. 11 and 12 show a fifth embodiment of the present invention.

In the present invention, the headers 11 are partitioned by two partitions 16 to form three passes P1, P2, P3. At a U-turn portion in the left side header 11 between the second pass P2 and the third passes P3, the aforementioned decompressing means 20 is provided. Accordingly, the first and second passes P1, P2 constitute a first condensing zone C1, and the third pass P3 constitutes the second condensing zone C2 (re-condensing portion).

Since the other structure is the same as in the aforementioned embodiment, the explanation will be omitted by allotting the same reference numeral to the corresponding portion.

Figure 13:
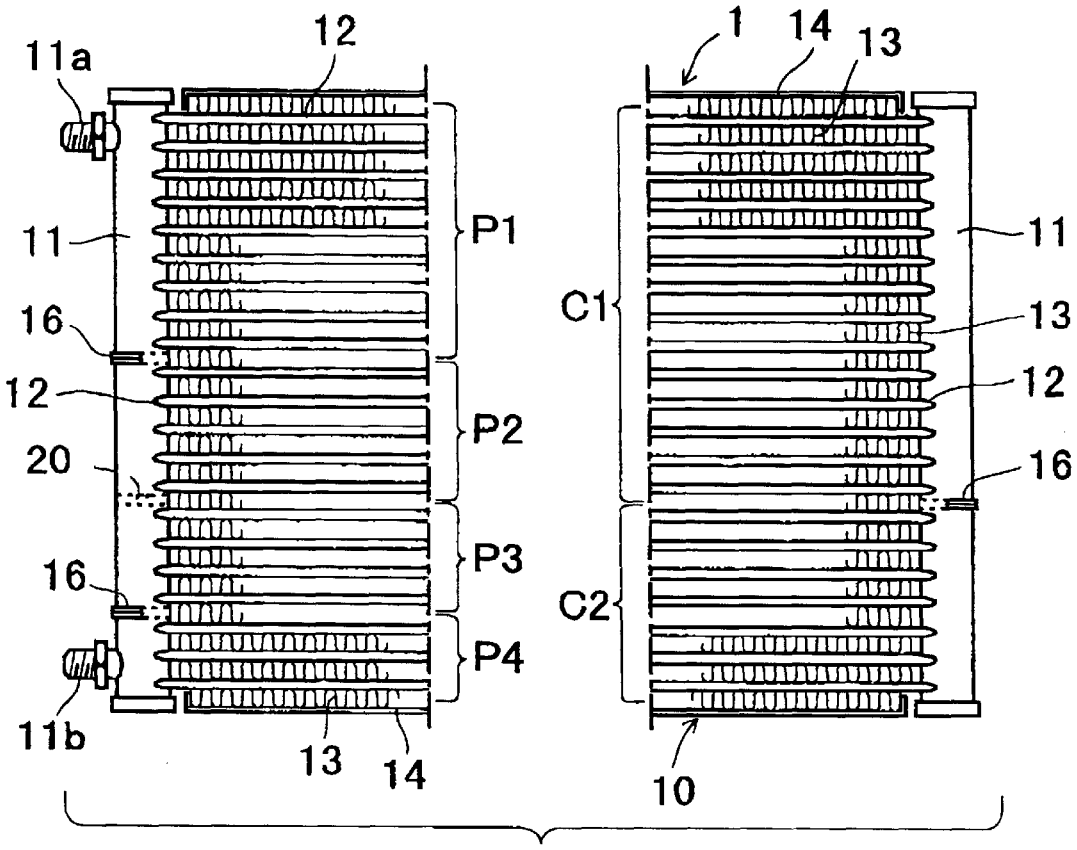
FIG. 13 is a front view of a condenser according to a sixth embodiment of the present invention.
Figure 14:
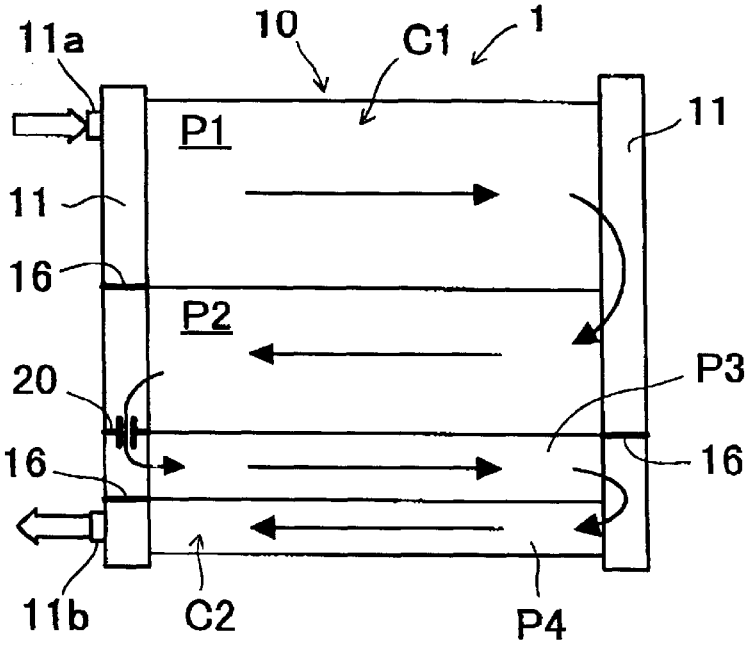
FIG. 14 illustrates a refrigerant circuit structure of the condenser according to the sixth embodiment of the present invention.

FIGS. 13 and 14 show a sixth embodiment of the present invention.

In the present invention, the headers 11 are partitioned by three partitions 16 to form four passes P1, P2, P3, P4. At a U-turn portion in the left side header 11 between the second pass P2 and the third passes P3, the aforementioned decompressing means 20 is provided. Accordingly, the first and second passes P1, P2 constitute a first condensing zone C1, and the third and fourth passes P3, P4 constitute the second condensing zone C2 (re-condensing portion).

Since the other structure is the same as in the aforementioned embodiment, the explanation will be omitted by allotting the same reference numeral to the corresponding portion.

Figure 15:
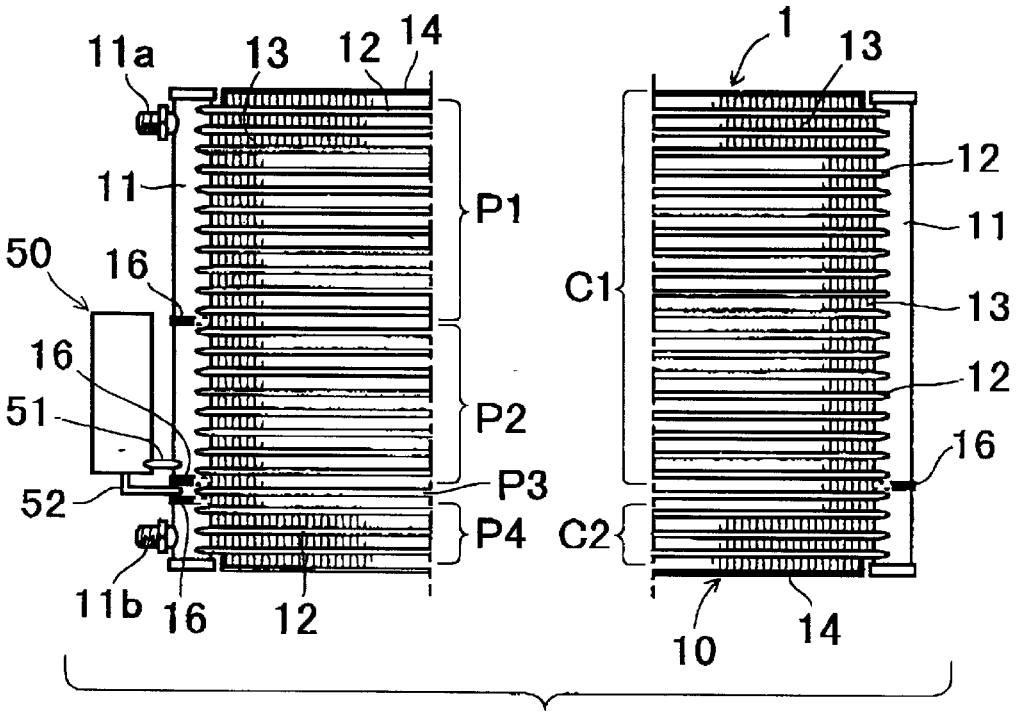
FIG. 15 is a front view of a condenser according to a seventh embodiment of the present invention.
Figure 16:
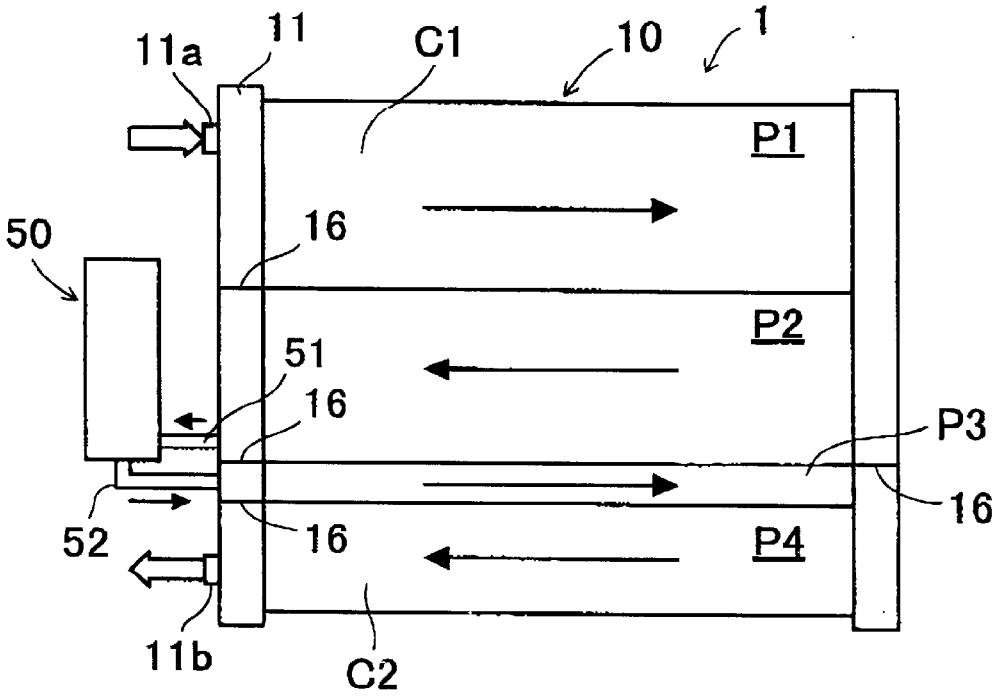
FIG. 16 illustrates a refrigerant circuit structure of the condenser according to the seventh embodiment of the present invention.

FIG. 15 shows a seventh embodiment according to the present invention.

The condenser according to this embodiment corresponds to a condenser in which a receiver tank 50 is added to the condenser shown as the first to third embodiments.

In the condenser, partitions 16 are provided at certain portions of the headers 11 to divide a plurality of flat tubes into a first pass P1, a second pass P2, a third pass p3 and a fourth pass P4. In this embodiment, between the first and second passes P1, P2 as well as between the third pass and fourth pass P3, P4, partitions 16 are provided in only in one of the headers 11. Between the first and second passes P1, P2 as well as between the third pass and fourth pass P3, P4, the inside space of the other header is communicated with each other. Between the second and third passes P2, P3, partitions 16 are provided at both the headers 11 at the same height (level). Accordingly, the first and second passes P1, P2 are independent from the third and fourth passes P3, P4.

Among these passes P1, P2, P3, P4 the third pass P3 constitutes a decompressing pass as a decompressing means. The first and second pass P1, P2 above the decompressing pass P3 constitute a first condensing zone C1, the fourth pass P4 below the decompressing pass P3 constitutes a second condensing zone C2 (re-condensing portion).

In detail, a first pass P1 is formed by a total of 12 flat tubes including the $1^{st}$ to $12^{th}$ flat tubes 12, a second pass P2 is formed by a total of 10 flat tubes including the $13^{th}$ to $22^{nd}$ flat tubes 12, a decompressing P3 is formed by the $23^{rd}$ flat tube 12 and a fourth pass P4 is formed by the $24^{th}$ to $26^{th}$ flat tubes 12.

The receiver tank 50 provided along the left side header 11 separates the refrigerant condensed in the first condensing zone C1 into liquid and gas to introduce the liquid refrigerant into the decompressing pass P3. The inlet portion of the receiver tank 50 is connected to the portion of the left side header 11 corresponding to the second pass P2 via a pipe 51. The outlet portion of the receiver tank 50 is connected to the portion of the left side header 11 corresponding to the decompressing pass P3 via a pipe 52.

In the condenser 1, refrigerant introduced into the header 11 through the refrigerant inlet 11*a* passes through the core 10 by way of the first and second passes P1, P2 to the receiver tank 50. Then, the refrigerant passes through the decompressing pass P3 and then passes through the fourth pass p4 to flow out from the refrigerant outlet 11*b*.

As shown in FIG. 4, the aforementioned condenser 1 constitutes an automobile air conditioning refrigeration system together with a compressor 2, a receiver tank 5, an expansion valve 3 and an evaporator 4 connected by refrigerant pipes. In this case, the receiver tank 5 is not required.

In this refrigeration system, gas refrigerant with high-temperature and high-pressure sent out from the compressor 2 flows into the condenser 1. In the condenser 1, the refrigerant passes through the first and second passes P1, P2, i.e., the first condensing zone C1, to be condensed and liquified. As a result, the status of the refrigerant changes from the point B to the point Ct1, as shown in FIG. 5. Then, the refrigerant flows into the receiver tank 50 to be separated into liquid and gas. Thereafter, only the liquid refrigerant is introduced into the decompressing pass P3.

Since the decompressing pass P3 is small in number of tuber as and in passage cross-sectional area, as compared to the cross-sectional area of the upstream side pass P2, when the refrigerant passes through the decompressing pass P3, the refrigerant flow speed increases to cause a decompression of the refrigerant, resulting in an evaporation of some amount of the refrigerant. As a result, the status of the refrigerant changes from the point Ct1 to the point Ct2, as shown in FIG. 5. Then, the refrigerant is introduced into the fourth pass P4, i.e., the second condensing zone C2 (re-condensing zone). Thereafter, the low-pressure gaseous refrigerant is further cooled and condensed to lose a large amount of heat in the second condensing zone C2 (re-condensing zone). As a result, the status of the refrigerant changes from the point Ct2 to the point Ct3, as shown in FIG. 5.

The refrigerant having an increased heat absorption ability by the loss of a large amount of heat is decompressed and expanded by the expansion valve 3 to cause a change of the refrigerant status from the point Ct3 to the point Dt, as shown in FIG. 5. Thereafter, the low-pressure and low-temperature refrigerant in a gaseous state is sent into the evaporator 4 to be evaporated by exchanging heat with air in a car. As a result, the status of the refrigerant changes from the point Dt to the point A, as shown in FIG. 5. Then, the refrigerant is sent back into the condenser 1.

Therefore, the condenser according to this embodiment can also obtain the same enhanced refrigeration effects as in each of aforementioned embodiments.

In the condenser 1 according to this embodiment, since the receiver tank 50 is disposed before the decompressing pass P3, only the liquid refrigerant can be introduced into the decompressing pass P3, resulting in an efficient decompression and expansion of the refrigerant by the decompressing pass P3, which in turn enables a stable refrigeration effect. Furthermore, an appropriate amount of refrigerant is constantly introduced from the receiver tank 50 into the decompressing pass P3, preventing a stagnation of liquid refrigerant at around the inlet portion of the decompressing pass P3, which enables to effectively decompress the refrigerant. Thus, enhanced stable refrigeration effects can be obtained.

In the present embodiment, enhanced refrigeration effects can be obtained while avoiding an increase of the refrigerant pressure.

Since the other structure is the same as in the aforementioned embodiment, the explanation will be omitted by allotting the same reference numeral to the corresponding portion.

Figure 17:
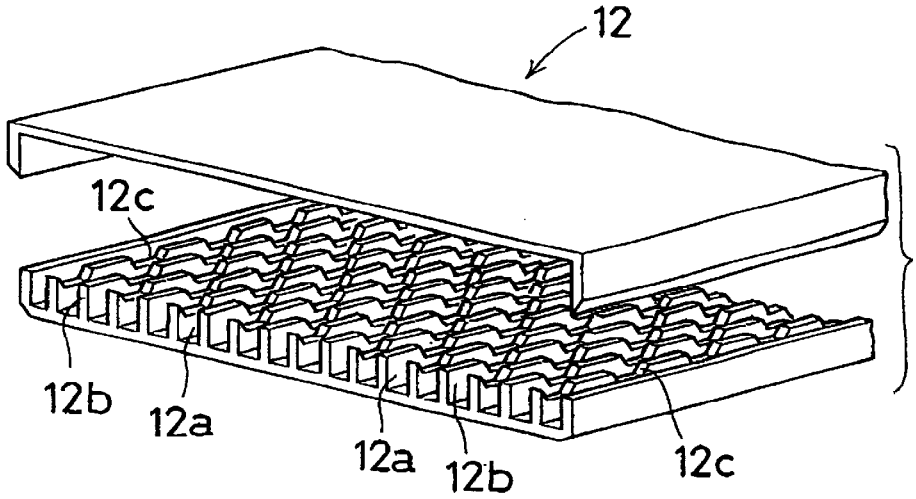
FIG. 17 is a perspective exploded view of a flat tube which can be used as a variation of the heat exchanging tube of the present invention.
Figure 18A:
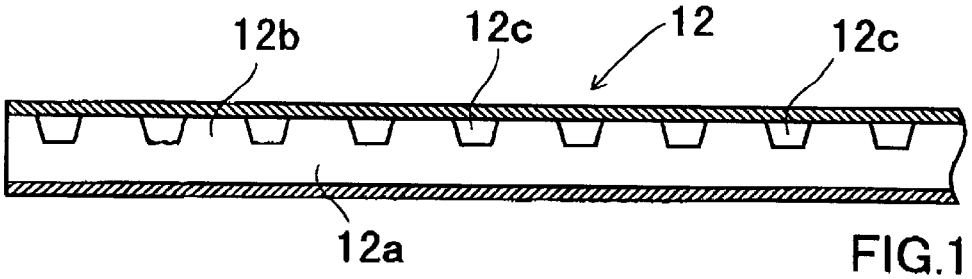
FIG. 18A is a front cross-sectional view thereof and FIG. 18B is a side cross-sectional view thereof.
Figure 18B:
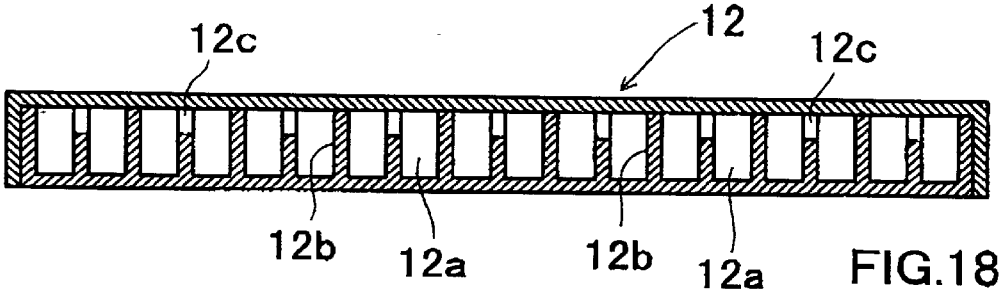

In the present invention, as a heat exchanging tube, as shown in FIGS. 17 and 18, it is possible to use a flat tube having a plurality of refrigerant passes 12*a* partitioned by partitioning walls 12*b* and a plurality of communicating apertures 12*c* formed in the partitioning walls 12*b* so as to communicate the adjacent refrigerant passages.

Figure 19:
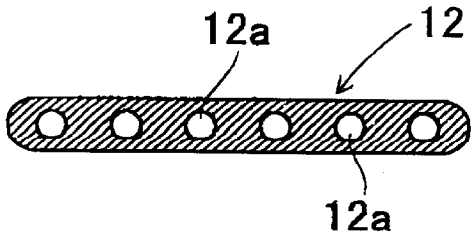
FIG. 19 is a cross-sectional view of a circular passage flat tube showing a variation of a tube for used as a decompressing pass.

In the first, second, third and seventh embodiments, the tube 12 constituting the decompressing pass P3 and the other tubes 12 are the same tubes. However, the present invention is not limited to the above. In order to enhance the decompressing effects, a tube constituting the decompressing pass may be different in structure from the other tube. For example, as shown in FIG. 19, a so-called harmonica tube 12 having a plurality of small round passages 12*a* may be used as a decompressing tube.

In the present invention, as the tube constituting the decompressing pass, it is not always necessary to use a straight tube. A meandered shape tube used for serpentine type heat exchanger can be used as a tube for the compressing pass.

Figure 20:
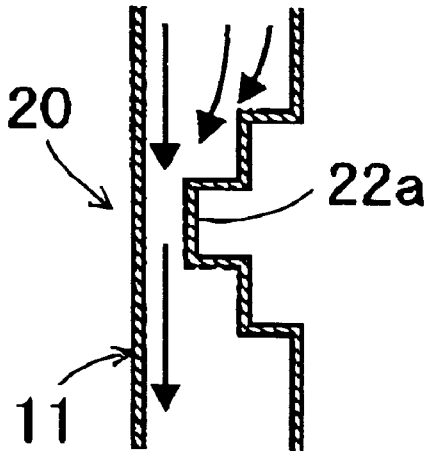
FIG. 20 is a cross-section of a modification of a decompressing means of the condenser according to the present invention, and corresponds to the cross-section shown in FIG. 10B.
Figure 21:
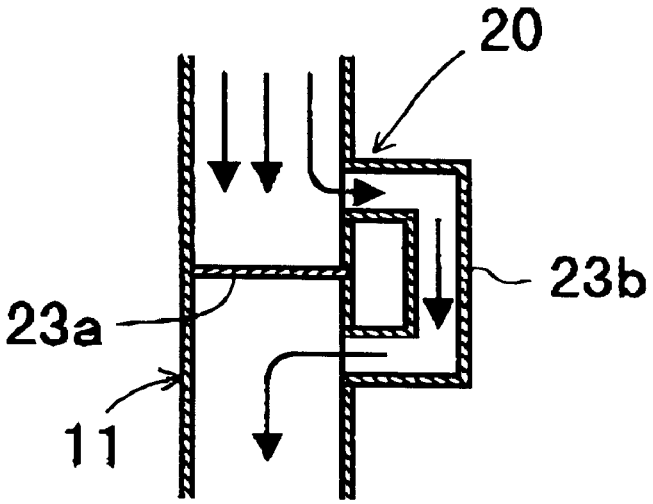
FIG. 21 is a cross-section of a further modification of a decompressing means of the condenser according to the present invention, and corresponds to the cross-section shown in FIG. 10B.
Figure 22:
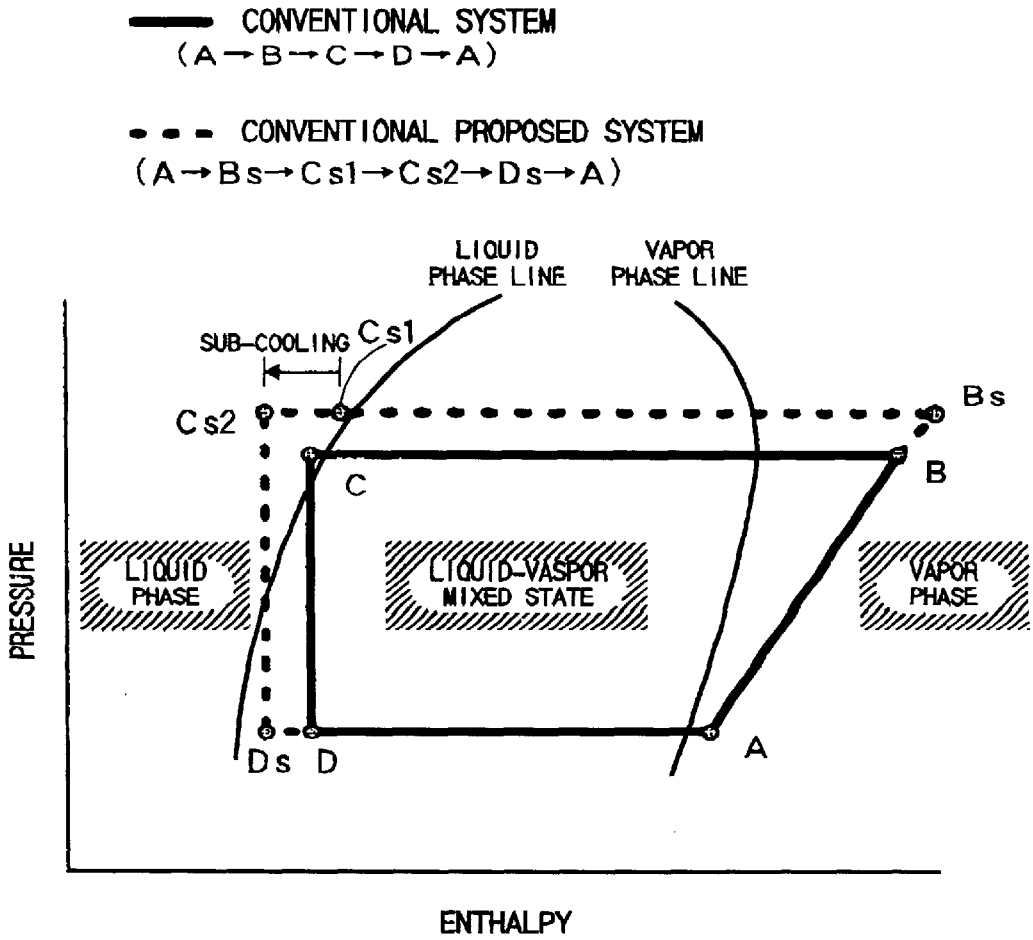
FIG.22 RELATED ART
FIG. 22 illustrates a Mollier chart in a conventional refrigerant cycle.
Figure 23:
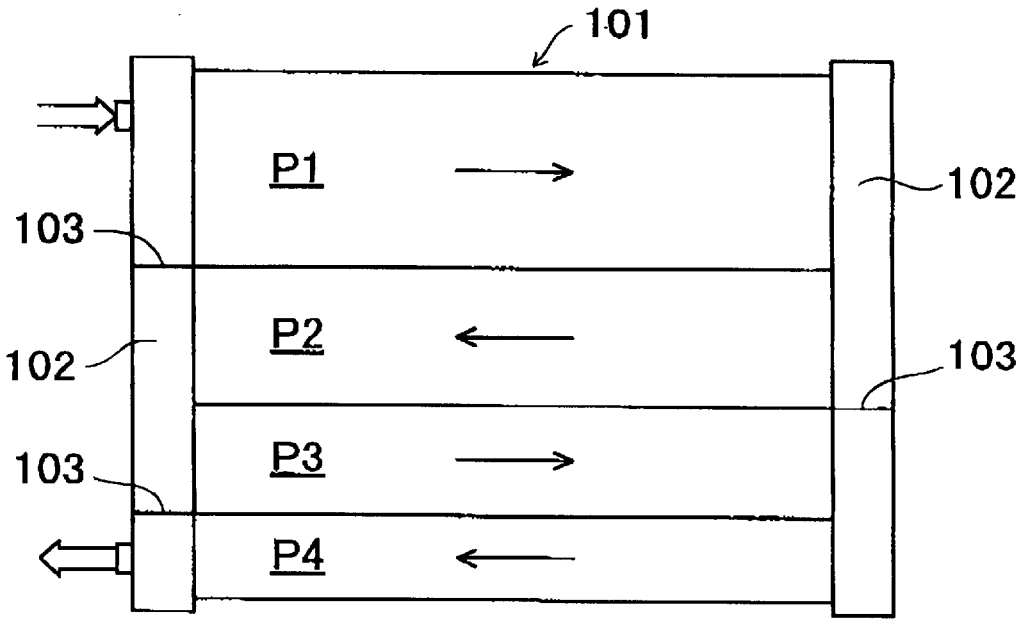
FIG.23 RELATED ART
FIG. 23 illustrates a refrigerant circuit structure of a conventional multi-flow type condenser.
Figure 24:
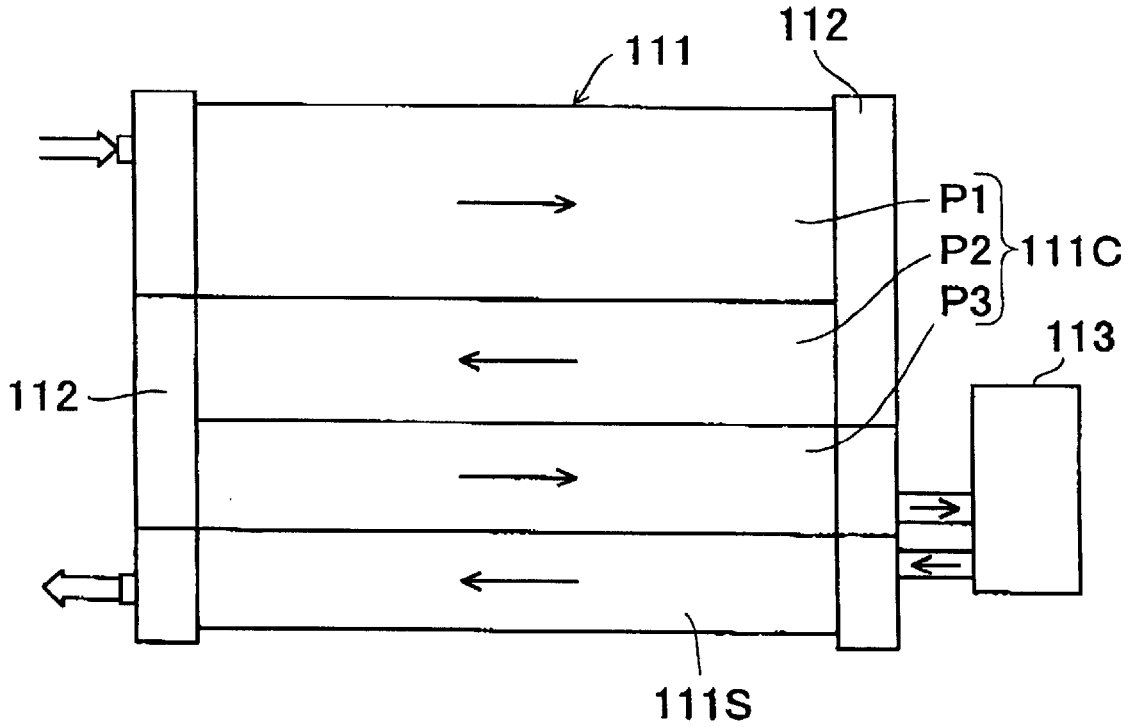
FIG.24 RELATED ART
FIG. 24 illustrates a refrigerant circuit structure in a conventional condenser with a receiver tank.

In the aforementioned fourth to sixth embodiments, a plate member with an orifice tube as a decompressing means 20 is used. However, the present invention is not limited to this. For example, as shown in FIG. 20, a decompressing means forming region of the header may be a reduced diameter portion. Alternatively, as shown in FIG. 21, a decompressing means may include a plate member 23*a* partitioning an inside of the header 11 and a refrigerant detour pipe 23*b* with one end thereof connected to the header 11 in fluid communication at an upstream side of the plate member 23*a* and the other end thereof connected to the header 11 in fluid communication at a downstream side of the plate member 23*a*.

As mentioned above, in the condenser according to the present invention, since the refrigerant is decompressed in a process of condensing, an amount of the heat rejection is increased without rasing the refrigerant pressure. Thus, an excellent refrigeration ability can be obtained.

In summary, a condenser according to the present invention includes:

a refrigerant inlet;

a refrigerant outlet;

a core portion having a refrigerant passage for introducing refrigerant from the refrigerant inlet to the refrigerant outlet while condensing the refrigerant; and decompressing means provided at a part of the refrigerant passage, the decompressing means decompressing a refrigerant pressure.

The refrigerant passage located at an upstream side of the decompressing means condensates at least a part of high-pressure gaseous refrigerant into a liquified refrigerant, wherein the decompressing means decompresses the liquified refrigerant into a low-pressure gaseous refrigerant, and wherein the refrigerant passage located at a downstream side of the decompressing means re-condensates the low-pressure gaseous refrigerant.

The condenser may further comprises a liquid holding portion for holding the liquified refrigerant at the upstream side of the decompressing means.

A refrigerant passage cross-sectional area of the decompressing means may be smaller than a cross-sectional area of the refrigerant passage located at an upstream side of the decompressing means and that of the refrigerant passage located at a downstream side of the decompressing means.

The core portion may include a plurality of heat exchanging tubes with opposite ends thereof connected to a pair of spaced parallel headers in fluid communication.

The condenser may further comprises at least one partition provided in at least one of the headers to divide the plurality of heat exchanging tubes into a plurality of passes, whereby the refrigerant passes each of the passes in turn, wherein the plurality of passes include a first pass to which the refrigerant inlet is connected and a final pass to which the refrigerant outlet is connected, and wherein the decompressing means is disposed at a part of the refrigerant passage located between the first pass and the final pass.

The plurality of passes may include the first pass, the final pass and one or a plurality of intermediate passes, and wherein at least one of the intermediate passes constitutes a decompressing pass as the decompressing means.

The decompressing pass may be at least one of the intermediate passes adjacent to the final pass at the upstream side of the final pass.

A ratio of a total cross-sectional area of all of the passes located at an upstream side of the decompressing pass to a total cross-sectional area of all of the passes located at a downstream side of the decompressing pass may be from 65:35 to 35:10.

A passage cross-sectional area of the decompressing pass may be smaller than a cross-sectional area of the pass adjacent to the decompressing means at an upstream side of the decompressing means and that of the pass adjacent to the decompressing means at a downstream side of the decompressing means.

A passage cross-sectional area of the decompressing pass may be 10% to 50% of a cross-sectional area of the pass adjacent to the decompressing pass at an upstream side of the decompressing pass.

A passage cross-sectional area of the decompressing pass may be 10% to 55% of a cross-sectional area of the pass adjacent to the decompressing pass at a downstream side of the decompressing pass.

A passage cross-sectional area of the decompressing pass may be 2% to 10% of a total cross-sectional area of all of the passes.

The heat exchanging tube constituting the decompressing pass may have an equivalent diameter smaller than an equivalent diameter of the heat exchanging tube constituting each of the passes adjacent to the decompressing pass at an upstream and downstream sides of the decompressing pass.

The heat exchanging tube constituting the decompressing pass may have a cross-sectional area smaller than a cross-sectional area of the heat exchanging tube constituting each of the passes adjacent to the decompressing pass at an upstream and downstream sides of the decompressing pass.

The heat exchanging tube constituting the decompressing pass may have a portion partially small in internal diameter.

The number of the heat exchanging tubes constituting the decompressing pass may be smaller than that of the heat exchanging tubes constituting the passes adjacent to the decompressing pass at an upstream and downstream sides of the decompressing pass. The number of the heat exchanging tubes constituting the decompressing pass may be 1 to 5.

The number of the heat exchanging tubes constituting the pass adjacent to the decompressing pass at an upstream side of the decompressing pass may be 3 to 40.

The number of the heat exchanging tubes constituting the pass adjacent to the decompressing pass at a downstream side of the decompressing pass may be 3 to 12.

The heat exchanging tube constituting the decompressing pass may be formed to have a non-straight shape.

The passes located at a downstream side of the decompressing pass may include a condensing zone for condensing gaseous refrigerant passed through the decompressing means and a sub-cooling zone for sub-cooling liquified refrigerant passed through the decompressing means.

The decompressing means may be provided in the header.

The refrigerant passage located at an upstream side of the decompressing means may constitute a first condensing zone including one or plurality of the passes, and the refrigerant passage located at a downstream side of the decompressing means constitutes and second condensing zone including one or plurality of the passes, and wherein the decompressing means is disposed at a refrigerant U-turn portion in the header between the first and second condensing zones.

The decompressing means may include a plate member partitioning an inside of the header and an orifice tube penetrating the plate member for passing refrigerant.

The decompressing means may be a reduced diameter portion of the header.

The decompressing means may include a plate member partitioning an inside of the header and a refrigerant detour pipe with one end thereof connected to the header in fluid communication at an upstream side of the plate member and the other end thereof connected to the header in fluid communication at a downstream side of the plate member.

The condenser may further comprises a receiver tank, wherein the receiver tank is disposed at an upstream side of the decompressing means so that the receiver tank receives liquified refrigerant liquified by the refrigerant passage located at an upstream side of the decompressing means to separate the liquified refrigerant into a liquid refrigerant and a gaseous refrigerant and introduces the liquid refrigerant into the decompressing means, whereby the liquid refrigerant is decompressed by the decompressing means into a low-pressure gaseous refrigerant which in turn is re-condensed by the refrigerant passage located at a downstream side of the decompressing means.

The plurality of passes may include the first pass, the final pass and one or a plurality of intermediate passes, and wherein at least one of the intermediate passes constitutes a decompressing pass as the decompressing means.

The decompressing pass is at least one of the intermediate passes adjacent to the final pass at the upstream side of the final pass.

A passage cross-sectional area of the decompressing pass may be smaller than a cross-sectional area of the pass adjacent to the decompressing means at an upstream side of the decompressing means and that of the pass adjacent to the decompressing means at a downstream side of the decompressing means.

The number of the heat exchanging tubes constituting the decompressing pass may be smaller than that of the heat exchanging tubes constituting the passes adjacent to the decompressing pass at an upstream and downstream sides of the decompressing pass.

A condenser may comprises:

a refrigerant inlet;

a refrigerant outlet; and a heat exchanging core including one or a plurality of heat exchanging tubes which connect the refrigerant inlet and the refrigerant outlet in fluid communication, wherein the heat exchanging core includes:

a condensing portion for condensing at least a part of a high-pressure and high-temperature gaseous refrigerant introduced through the refrigerant inlet into a liquified refrigerant by exchanging heat between the gaseous refrigerant and ambient air;

a decompressing evaporation portion having a cross-sectional area smaller than a cross-sectional area of the condensing portion, wherein the decompressing evaporation portion decompresses the liquified refrigerant liquified at the condensing portion to evaporate at least a part of the liquified refrigerant into a gaseous refrigerant; and a re-condensing portion having a cross-sectional area larger than a cross-sectional area of the condensing portion, whereby the gaseous refrigerant decompressed and evaporated at the decompressing evaporation portion is exchanged heat between the gaseous refrigerant and ambient air to be re-condensed.

A refrigeration system for use in an air conditioner which constitutes a refrigeration cycle in which refrigerant is sealed, may comprises:

a compressor;

a condenser;

an expansion valve; and an evaporator, wherein the condenser includes:

a refrigerant inlet for introducing refrigerant sent from the compressor into the condenser;

a refrigerant outlet for sending the refrigerant from the condenser to the expansion valve;

a heat exchanging portion having a refrigerant passage for introducing the refrigerant to the refrigerant outlet while condensing the refrigerant introduced from the refrigerant inlet; and a decompressing portion provided at a part of the refrigerant passage for decompressing a refrigerant pressure, wherein the heat exchanging portion includes a pair of parallel headers disposed at a certain distance, a plurality of heat exchanging tubes with opposite ends connected to the headers in fluid communication and at least one partitioning member provided at at least one of the headers to divide the plurality of heat exchanging tubes into a plurality of heat exchanging passes, whereby the refrigerant passes through each of the passes in turn, wherein the plurality of passes include a first pass connected to the refrigerant inlet and a final pass connected to the refrigerant outlet, wherein the decompressing portion is provided at a part of the refrigerant passage between the first pass and the final pass, wherein the decompressing portion has a passage cross-sectional area smaller than a cross-sectional area of the refrigerant passage adjacent to the decompressing portion at an upstream side of the decompressing portion and that of the refrigerant passage adjacent to the decompressing portion at a downstream side of the decompressing portion, wherein the refrigerant passage located at an upstream side of the decompressing means condenses at least a part of a high-pressure gaseous refrigerant compressed by the compressor by exchanging heat between the high-pressure gaseous refrigerant and ambient air into a liquified refrigerant, wherein the decompressing portion decompresses the liquified refrigerant into a low-pressure gaseous refrigerant, and wherein the refrigerant passage located at a downstream side of the decompressing means re-condenses the low-pressure gaseous refrigerant by exchanging heat between the low-pressure gaseous refrigerant and ambient air.

The present invention claims a priority based on Japanese Patent Application Nos. 11-100285 filed on Apr. 7, 1999, 11-263009 filed on Sep. 17, 1999, 2000-39000 filed on Feb. 17, 2000, and 2000-44186 filed on Feb. 22, 2000, the content of which is incorporated hereinto by reference in its entirety.

The terms and descriptions in this specification are used only for explanatory purposes and the present invention is not limited to these, but many modifications and substitutions may be made without departing from the spirit of the scope of the present invention which is defined by the appended claims.

What is claimed is:

1. A condenser, comprising:

a refrigerant inlet;

a refrigerant outlet;

a core portion having a refrigerant passage for introducing refrigerant from said refrigerant inlet to said refrigerant outlet while condensing the refrigerant; and decompressing means provided at a part of said refrigerant passage, said decompressing means decompressing a refrigerant pressure.

2. The condenser as recited in claim 1, wherein said refrigerant passage located at an upstream side of said decompressing means condensates at least a part of high-pressure gaseous refrigerant into a liquified refrigerant, wherein said decompressing means decompresses the liquified refrigerant into a low-pressure gaseous refrigerant, and wherein said refrigerant passage located at a downstream side of said decompressing means re-condensates the low-pressure gaseous refrigerant.

3. The condenser as recited in claim 2, further comprising a liquid holding portion for holding the liquified refrigerant at the upstream side of said decompressing means.

4. The condenser as recited in claim 1, wherein a refrigerant passage cross-sectional area of said decompressing means is smaller than a cross-sectional area of said refrigerant passage located at an upstream side of said decompressing means and that of said refrigerant passage located at a downstream side of said decompressing means.

5. The condenser as recited in claim 1, wherein said core portion includes a plurality of heat exchanging tubes with opposite ends thereof connected to a pair of spaced parallel headers in fluid communication.

6. The condenser as recited in claim 5, further comprising at least one partition provided in at least one of said headers to divide said plurality of heat exchanging tubes into a plurality of passes, whereby the refrigerant passes each of said passes in turn, wherein said plurality of passes include a first pass to which said refrigerant inlet is connected and a final pass to which said refrigerant outlet is connected, and wherein said decompressing means is disposed at a part of said refrigerant passage located between said first pass and said final pass.

7. The condenser as recited in claim 6, wherein said plurality of passes include said first pass, said final pass and one or a plurality of intermediate passes, and wherein at least one of said intermediate passes constitutes a decompressing pass as said decompressing means.

8. The condenser as recited in claim 7, wherein said decompressing pass is at least one of said intermediate passes adjacent to said final pass at the upstream side of said final pass.

9. The condenser as recited in claim 6, wherein a ration of a total cross-sectional area of all of said passes located at an upstream side of said decompressing pass to a total cross-sectional area of all of said passes located at a downstream side of said decompressing pass is from 65:35 to 35:10.

10. The condenser as recited in claim 7, wherein a passage cross-sectional area of said decompressing pass is smaller than a cross-sectional area of said pass adjacent to said decompressing means at an upstream side of said decompressing means and that of said pass adjacent to said decompressing means at a downstream side of said decompressing means.

11. The condenser as recited in claim 7, wherein passage cross-sectional area of said decompressing pass is 10% to 50% of a cross-sectional area of said pass adjacent to said decompressing pass at an upstream side of said decompressing pass.

12. The condenser as recited in claim 7, wherein a passage cross-sectional area of said decompressing pass is 10% to 55% of a cross-sectional area of said pass adjacent to said decompressing pass at a downstream side of said decompressing pass.

13. The condenser as recited in claim 7, wherein a passage cross-sectional area of said decompressing pass is 2% to 10% of a total cross-sectional area of all of said passes.

14. The condenser as recited in claim 7, wherein said heat exchanging tube constituting said decompressing pass has an equivalent diameter smaller than an equivalent diameter of said heat exchanging tube constituting each of said passes adjacent to said decompressing pass at an upstream and downstream sides of said decompressing pass.

15. The condenser as recited in claim 7, wherein said heat exchanging tube constituting said decompressing pass has a cross-sectional area smaller than a cross-sectional area of said heat exchanging tube constituting each of said passes adjacent to said decompressing pass at an upstream and downstream sides of said decompressing pass.

16. The condenser as recited in claim 7, wherein said heat exchanging tube constituting said decompressing pass has a portion partially small in internal diameter.

17. The condenser as recited in claim 7, wherein the number of said heat exchanging tubes constituting said decompressing pass is smaller than that of said heat exchanging tubes constituting said passes adjacent to said decompressing pass at an upstream and downstream sides of said decompressing pass.

18. The condenser as recited in claim 17, wherein the number of said heat exchanging tubes constituting said decompressing pass is 1 to 5.

19. The condenser as recited in claim 17, wherein the number of said heat exchanging tubes constituting said pass adjacent to said decompressing pass at an upstream side of said decompressing pass is 3 to 40.

20. The condenser as recited in claim 17, wherein the number of said heat exchanging tubes constituting said pass adjacent to said decompressing pass at a downstream side of said decompressing pass is 3 to 12.

21. The condenser as recited in claim 7, wherein said heat exchanging tube constituting said decompressing pass is formed to have a non-straight shape.

22. The condenser as recited in claim 7, wherein said passes located at a downstream side of said decompressing pass include a condensing zone for condensing gaseous refrigerant passed through said decompressing means and a sub-cooling zone for sub-cooling liquified refrigerant passed through said decompressing means.

23. The condenser as recited in claim 6, wherein said decompressing means is provided in said header.

24. The condenser as recited in claim 23, wherein said refrigerant passage located at an upstream side of said decompressing means constitutes a first condensing zone including one or plurality of said passes, and said refrigerant passage located at a downstream side of said decompressing means constitutes a second condensing zone including one or plurality of said passes, and wherein said decompressing means is disposed at a refrigerant U-turn portion in said header between said first and second condensing zones.

25. The condenser as recited in claim 23, wherein said decompressing means includes a plate member partitioning an inside of said header and an orifice tube penetrating said plate member for passing refrigerant.

26. The condenser as recited in claim 23, wherein said decompressing means is a reduced diameter portion of said header.

27. The condenser as recited in claim 23, wherein said decompressing means includes a plate member partitioning an inside of said header and a refrigerant detour pipe with one end thereof connected to said header in fluid communication at an upstream side of said plate member and the other end thereof connected to said header in fluid communication at a downstream side of said plate member.

28. The condenser as recited in claim 6, further comprising a receiver tank, wherein said receiver tank is disposed at an upstream side of said decompressing means so that said receiver tank receives liquified refrigerant liquified by said refrigerant passage located at an upstream side of said decompressing means to separate the liquified refrigerant into a liquid refrigerant and a gaseous refrigerant and introduces the liquid refrigerant into said decompressing means, whereby the liquid refrigerant is decompressed by said decompressing means into a low-pressure gaseous refrigerant which in turn is re-condensed by said refrigerant passage located at a downstream side of said decompressing means.

29. The condenser as recited in claim 28, wherein said plurality of passes include said first pass, said final pass and one or a plurality of intermediate passes, and wherein at least one of said intermediate passes constitutes a decompressing pass as said decompressing means.

30. The condenser as recited in claim 29, wherein said decompressing pass is at least one of said intermediate passes adjacent to said final pass at the upstream side of said final pass.

31. The condenser as recited in claim 29, wherein a passage cross-sectional area of said decompressing pass is smaller than a cross-sectional area of said pass adjacent to said decompressing means at an upstream side of said decompressing means and that of said pass adjacent to said decompressing means at a downstream side of said decompressing means.

32. The condenser as recited in claim 29, wherein the number of said heat exchanging tubes constituting said decompressing pass is smaller than that of said heat exchanging tubes constituting said passes adjacent to said decompressing pass at an upstream and downstream sides of said decompressing pass.

33. A condenser, comprising:

a refrigerant inlet;

a refrigerant outlet; and a heat exchanging core including one or a plurality of heat exchanging tubes which connect said refrigerant inlet and said refrigerant outlet in fluid communication, wherein said heat exchanging core includes:

a condensing portion for condensing at least a part of a high-pressure and high-temperature gaseous refrigerant introduced through said refrigerant inlet into a liquified refrigerant by exchanging heat between the gaseous refrigerant and ambient air;

a decompressing evaporation portion having a cross-sectional area smaller than a cross-sectional area of said condensing portion, wherein said decompressing evaporation portion decompresses the liquified refrigerant liquified at said condensing portion to evaporate at least a part of the liquified refrigerant into a gaseous refrigerant; and a re-condensing portion having a cross-sectional area larger than a cross-sectional area of said condensing portion, whereby the gaseous refrigerant decompressed and evaporated at said decompressing evaporation portion is exchanged heat between the gaseous refrigerant and ambient air to be re-condensed.

34. A refrigeration system for use in an air conditioner which constitutes a refrigeration cycle in which refrigerant is sealed, comprising:

a compressor;

a condenser;

a decompressing member; and an evaporator, wherein said condenser includes:

a refrigerant inlet for introducing refrigerant sent from said compressor into said condenser;

a refrigerant outlet for sending the refrigerant from said condenser to said decompression member;

a heat exchanging portion having a refrigerant passage for introducing the refrigerant to said refrigerant outlet while condensing the refrigerant introduced from said refrigerant inlet; and a decompressing portion provided at a part of said refrigerant passage for decompressing a refrigerant pressure, wherein said heat exchanging portion includes a pair of parallel headers disposed at a certain distance, a plurality of heat exchanging tubes with opposite ends connected to said headers in fluid communication and at least on partitioning member provided at at least one of said headers to divide said plurality of heat exchanging tubes into a plurality of heat exchanging passes, whereby the refrigerant passes through each of said passes in turn, wherein said plurality of passes include a first pass connected to said refrigerant inlet and a final pass connected to said refrigerant outlet, wherein said decompressing portion is provided at a part of said refrigerant passage between said first and said final pass, wherein said decompressing portion has a passage cross-sectional area smaller than a cross-sectional area of said refrigerant passage adjacent to said decompressing portion at an upstream side of said decompressing portion and that of said refrigerant passage adjacent to said decompressing portion at a downstream side of said decompressing portion, wherein said refrigerant passage located at an upstream side of said decompressing means condenses at least a part of a high-pressure gaseous refrigerant compressed by said compressor by exchanging heat between the high-pressure gaseous refrigerant and ambient air into a liquified refrigerant, wherein said decompressing portion decompresses the liquified refrigerant into a low-pressure gaseous refrigerant, and wherein said refrigerant passage located at a downstream side of said decompressing means re-condenses the low-pressure gaseous refrigerant by exchanging heat between the low-pressure gaseous refrigerant and ambient air.

* * * * *

UNITED STATES PATENT AND TRADEMARK OFFICE

CERTIFICATE OF CORRECTION

PATENT NO. : 6,250,103 B1
DATED : June 26, 2001
INVENTOR(S) : Watanabe et al.

It is certified that error appears in the above-identified patent and that said Letters Patent is hereby corrected as shown below:

Title page,
Title of the Invention, after "SYSTEM" delete "AND"

Claim 9,
Line 1, delete "ration" and insert -- ratio --

Claim 11,
Line 1, after "wherein" please insert -- a --

Column 21, claim 34,
Line 17, delete "on" and insert -- one --

Column 22, claim 34,
Line 2, after "first" please insert -- pass --

Signed and Sealed this

Second Day of April, 2002

*Attest:*

*Attesting Officer*

JAMES E. ROGAN
*Director of the United States Patent and Trademark Office*